US008783365B2

(12) United States Patent
McCoy et al.

(10) Patent No.: US 8,783,365 B2
(45) Date of Patent: Jul. 22, 2014

(54) SELECTIVE HYDRAULIC FRACTURING TOOL AND METHOD THEREOF

(75) Inventors: Matthew McCoy, Richmond, TX (US); Matthew Solfronk, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 319 days.

(21) Appl. No.: 13/193,028

(22) Filed: Jul. 28, 2011

(65) Prior Publication Data

US 2013/0025876 A1 Jan. 31, 2013

(51) Int. Cl.
*E21B 34/06* (2006.01)
*E21B 34/14* (2006.01)
*E21B 43/26* (2006.01)

(52) U.S. Cl.
CPC ..... *E21B 34/14* (2013.01); *E21B 43/26* (2013.01)
USPC ..... 166/373; 166/318; 166/376; 166/386

(58) Field of Classification Search
USPC ..... 166/308.1, 373, 386, 318, 332.3, 334.2
See application file for complete search history.

(56) References Cited

U.S. PATENT DOCUMENTS

| | | | |
|---|---|---|---|
| 2,238,895 | A | 4/1941 | Gage |
| 2,261,292 | A | 11/1941 | Salnikov |
| 2,301,624 | A | 11/1942 | Holt |
| 2,754,910 | A | 7/1956 | Derrick et al. |
| 2,983,634 | A | 5/1961 | Budininkas et al. |
| 3,106,959 | A | 10/1963 | Huitt et al. |
| 3,152,009 | A | 10/1964 | DeLong |
| 3,196,949 | A | 7/1965 | Thomas |
| 3,316,748 | A | 5/1967 | Lang et al. |
| 3,390,724 | A | 7/1968 | Caldwell |
| 3,395,758 | A | 8/1968 | Kelly et al. |
| 3,465,181 | A | 9/1969 | Colby et al. |
| 3,513,230 | A | 5/1970 | Rhees et al. |
| 3,637,446 | A | 1/1972 | Elliott et al. |
| 3,645,331 | A | 2/1972 | Maurer et al. |
| 3,765,484 | A | 10/1973 | Hamby, Jr. et al. |
| 3,768,563 | A | 10/1973 | Blount |
| 3,775,823 | A | 12/1973 | Adolph et al. |

(Continued)

FOREIGN PATENT DOCUMENTS

| | | |
|---|---|---|
| CA | 2783241 | 6/2011 |
| CA | 2783346 | 6/2011 |

(Continued)

OTHER PUBLICATIONS

Ambat, et al.; "Electroless Nickel-Plating on AZ91D Magnesium Alloy: Effect of Substrate Microstructure and Plating Parameters"; Surface and Coatings Technology; 179; pp. 124-134; (2004).

(Continued)

*Primary Examiner* — Yong-Suk (Philip) Ro
(74) *Attorney, Agent, or Firm* — Cantor Colburn LLP

(57) ABSTRACT

A selective downhole tool including a tubular having a longitudinal bore enabling passage of fluids there through. Having a valve opening in a wall of the tubular. An expandable ball seat selectively movable between a first size sized to trap a ball to block flow through the tubular. A larger second size sized to release the ball through the tubular. A valve cover longitudinally movable within the tubular, the valve cover including a dissolvable insert. Also included is a method of operating a downhole tool.

19 Claims, 10 Drawing Sheets

(56) References Cited

U.S. PATENT DOCUMENTS 3,878,889 A 4/1975 Seabourn
3,894,850 A 7/1975 Kovalchuk et al.
3,924,677 A 12/1975 Prenner et al.
4,010,583 A 3/1977 Highberg
4,039,717 A 8/1977 Titus
4,050,529 A 9/1977 Tagirov et al.
4,248,307 A 2/1981 Silberman et al.
4,372,384 A 2/1983 Kinney
4,373,584 A 2/1983 Silberman et al.
4,374,543 A 2/1983 Richardson
4,384,616 A 5/1983 Dellinger
4,399,871 A 8/1983 Adkins et al.
4,407,368 A 10/1983 Erbstoesser
4,422,508 A 12/1983 Rutledge, Jr. et al.
4,452,311 A 6/1984 Speegle et al.
4,498,543 A 2/1985 Pye et al.
4,499,048 A 2/1985 Hanejko
4,499,049 A 2/1985 Hanejko
4,534,414 A 8/1985 Pringle
4,539,175 A 9/1985 Lichti et al.
4,554,986 A 11/1985 Jones
4,640,354 A 2/1987 Boisson
4,664,962 A 5/1987 DesMarais, Jr.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,721,159 A 1/1988 Ohkochi et al.
4,738,599 A 4/1988 Shilling
4,768,588 A 9/1988 Kupsa
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,889,187 A 12/1989 Terrell et al.
4,890,675 A 1/1990 Dew
4,909,320 A 3/1990 Hebert et al.
4,929,415 A 5/1990 Okazaki
4,932,474 A 6/1990 Schroeder, Jr. et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,073,207 A 12/1991 Faure et al.
5,074,361 A 12/1991 Brisco et al.
5,084,088 A 1/1992 Okazaki
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,178,216 A 1/1993 Giroux et al.
5,181,571 A 1/1993 Mueller et al.
5,188,182 A 2/1993 Echols, III et al.
5,188,183 A 2/1993 Hopmann et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,253,714 A 10/1993 Davis et al.
5,271,468 A 12/1993 Streich et al.
5,282,509 A 2/1994 Schurr, III
5,293,940 A 3/1994 Hromas et al.
5,309,874 A 5/1994 Willermet et al.
5,310,000 A 5/1994 Arterbury et al.
5,318,746 A 6/1994 Lashmore
5,380,473 A 1/1995 Bogue et al.
5,392,860 A 2/1995 Ross
5,394,941 A 3/1995 Venditto et al.
5,398,754 A 3/1995 Dinhoble
5,407,011 A 4/1995 Layton
5,411,082 A 5/1995 Kennedy
5,417,285 A 5/1995 Van Buskirk et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,707,214 A 1/1998 Schmidt
5,709,269 A 1/1998 Head
5,720,344 A 2/1998 Newman
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,934,372 A 8/1999 Muth
5,960,881 A 10/1999 Allamon et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,032,735 A * 3/2000 Echols ..... 166/242.7
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb et al.
6,167,970 B1 1/2001 Stout et al.
6,173,779 B1 1/2001 Smith
6,189,616 B1 2/2001 Gano et al.

(56) References Cited

U.S. PATENT DOCUMENTS 6,213,202 B1 4/2001 Read, Jr.
6,220,350 B1 4/2001 Brothers et al.
6,220,357 B1 4/2001 Carmichael
6,228,904 B1 5/2001 Yadav et al.
6,237,688 B1 5/2001 Burleson et al.
6,238,280 B1 5/2001 Ritt et al.
6,241,021 B1 6/2001 Bowling
6,250,392 B1 6/2001 Muth
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,349,766 B1 2/2002 Bussear et al.
6,354,379 B2 3/2002 Miszewski et al.
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,609,569 B2 8/2003 Howlett et al.
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,049 B2 5/2005 Moyes
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,097,906 B2 8/2006 Gardner
7,108,080 B2 9/2006 Tessari et al.
7,111,682 B2 9/2006 Blaisdell
7,141,207 B2 11/2006 Jandeska, Jr. et al.
7,150,326 B2 12/2006 Bishop et al.
7,163,066 B2 1/2007 Lehr
7,174,963 B2 2/2007 Bertelsen
7,182,135 B2 2/2007 Szarka
7,210,527 B2 5/2007 Walker et al.
7,210,533 B2 5/2007 Starr et al.
7,217,311 B2 5/2007 Hong et al.
7,234,530 B2 6/2007 Gass
7,252,162 B2 8/2007 Akinlade et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,360,593 B2 4/2008 Constien
7,360,597 B2 4/2008 Blaisdell
7,387,165 B2 6/2008 Lopez de Cardenas et al.
7,401,648 B2 7/2008 Richard
7,416,029 B2 8/2008 Telfer et al.
7,426,964 B2 9/2008 Lynde et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,390 B2 3/2009 Gomez
7,503,399 B2 3/2009 Badalamenti et al.
7,510,018 B2 3/2009 Williamson et al.
7,513,311 B2 4/2009 Gramstad et al.
7,527,103 B2 5/2009 Huang et al.
7,537,825 B1 5/2009 Wardle et al.
7,552,777 B2 6/2009 Murray et al.
7,552,779 B2 6/2009 Murray
7,575,062 B2 8/2009 East, Jr.
7,591,318 B2 9/2009 Tilghman
7,600,572 B2 10/2009 Slup et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.

(56) References Cited

U.S. PATENT DOCUMENTS

| | | | |
|---|---|---|---|
| 7,723,272 | B2 | 5/2010 | Crews et al. |
| 7,726,406 | B2 | 6/2010 | Xu |
| 7,757,773 | B2 | 7/2010 | Rytlewski |
| 7,762,342 | B2 | 7/2010 | Richard et al. |
| 7,770,652 | B2 | 8/2010 | Barnett |
| 7,775,284 | B2 | 8/2010 | Richards et al. |
| 7,775,286 | B2 | 8/2010 | Duphorne |
| 7,784,543 | B2 | 8/2010 | Johnson |
| 7,798,225 | B2 | 9/2010 | Giroux et al. |
| 7,798,226 | B2 | 9/2010 | Themig |
| 7,798,236 | B2 | 9/2010 | McKeachnie et al. |
| 7,806,189 | B2 | 10/2010 | Frazier |
| 7,806,192 | B2 | 10/2010 | Foster et al. |
| 7,810,553 | B2 | 10/2010 | Cruickshank et al. |
| 7,810,567 | B2 | 10/2010 | Daniels et al. |
| 7,819,198 | B2 | 10/2010 | Birckhead et al. |
| 7,828,055 | B2 | 11/2010 | Willauer et al. |
| 7,833,944 | B2 | 11/2010 | Munoz et al. |
| 7,849,927 | B2 | 12/2010 | Herrera |
| 7,855,168 | B2 | 12/2010 | Fuller et al. |
| 7,861,781 | B2 | 1/2011 | D'Arcy |
| 7,874,365 | B2 | 1/2011 | East, Jr. et al. |
| 7,878,253 | B2 | 2/2011 | Stowe et al. |
| 7,896,091 | B2 | 3/2011 | Williamson et al. |
| 7,897,063 | B1 | 3/2011 | Perry et al. |
| 7,900,696 | B1 | 3/2011 | Nish et al. |
| 7,900,703 | B2 | 3/2011 | Clark et al. |
| 7,909,096 | B2 | 3/2011 | Clark et al. |
| 7,909,104 | B2 | 3/2011 | Bjorgum |
| 7,909,110 | B2 | 3/2011 | Sharma et al. |
| 7,913,765 | B2 | 3/2011 | Crow et al. |
| 7,931,093 | B2 | 4/2011 | Foster et al. |
| 7,938,191 | B2 | 5/2011 | Vaidya |
| 7,946,340 | B2 | 5/2011 | Surjaatmadja et al. |
| 7,958,940 | B2 | 6/2011 | Jameson |
| 7,963,331 | B2 | 6/2011 | Surjaatmadja et al. |
| 7,963,340 | B2 | 6/2011 | Gramstad et al. |
| 7,963,342 | B2 | 6/2011 | George |
| 7,980,300 | B2 | 7/2011 | Roberts et al. |
| 7,987,906 | B1 | 8/2011 | Troy |
| 8,020,619 | B1 | 9/2011 | Robertson et al. |
| 8,020,620 | B2 | 9/2011 | Daniels et al. |
| 8,025,104 | B2 | 9/2011 | Cooke, Jr. |
| 8,028,767 | B2 | 10/2011 | Radford et al. |
| 8,033,331 | B2 | 10/2011 | Themig |
| 8,039,422 | B1 | 10/2011 | Al-Zahrani |
| 8,056,628 | B2 | 11/2011 | Whitsitt et al. |
| 8,056,638 | B2 | 11/2011 | Clayton et al. |
| 8,109,340 | B2 | 2/2012 | Doane et al. |
| 8,127,856 | B1 | 3/2012 | Nish et al. |
| 8,163,060 | B2 | 4/2012 | Imanishi et al. |
| 8,211,248 | B2 | 7/2012 | Marya |
| 8,231,947 | B2 | 7/2012 | Vaidya et al. |
| 8,276,670 | B2 | 10/2012 | Patel |
| 8,327,931 | B2 | 12/2012 | Agrawal et al. |
| 8,403,037 | B2 | 3/2013 | Agrawal et al. |
| 2001/0045285 | A1 | 11/2001 | Russell |
| 2001/0045288 | A1 | 11/2001 | Allamon et al. |
| 2002/0000319 | A1 | 1/2002 | Brunet |
| 2002/0007948 | A1 | 1/2002 | Bayne et al. |
| 2002/0014268 | A1 | 2/2002 | Vann |
| 2002/0066572 | A1 | 6/2002 | Muth |
| 2002/0104616 | A1 | 8/2002 | De et al. |
| 2002/0136904 | A1 | 9/2002 | Glass et al. |
| 2002/0162661 | A1 | 11/2002 | Krauss et al. |
| 2003/0037925 | A1 | 2/2003 | Walker et al. |
| 2003/0075326 | A1 | 4/2003 | Ebinger |
| 2003/0104147 | A1 | 6/2003 | Bretschneider et al. |
| 2003/0111728 | A1 | 6/2003 | Thai et al. |
| 2003/0141060 | A1 | 7/2003 | Hailey et al. |
| 2003/0141061 | A1 | 7/2003 | Hailey et al. |
| 2003/0141079 | A1 | 7/2003 | Doane et al. |
| 2003/0150614 | A1 | 8/2003 | Brown et al. |
| 2003/0155114 | A1 | 8/2003 | Pedersen et al. |
| 2003/0155115 | A1 | 8/2003 | Pedersen et al. |
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2004/0005483 | A1 | 1/2004 | Lin |
| 2004/0020832 | A1 | 2/2004 | Richards et al. |
| 2004/0045723 | A1 | 3/2004 | Slup et al. |
| 2004/0089449 | A1 | 5/2004 | Walton et al. |
| 2004/0159428 | A1 | 8/2004 | Hammond et al. |
| 2004/0182583 | A1 | 9/2004 | Doane et al. |
| 2004/0256109 | A1 | 12/2004 | Johnson |
| 2004/0256157 | A1 | 12/2004 | Tessari et al. |
| 2005/0034876 | A1 | 2/2005 | Doane et al. |
| 2005/0051329 | A1 | 3/2005 | Blaisdell |
| 2005/0069449 | A1 | 3/2005 | Jackson et al. |
| 2005/0102255 | A1 | 5/2005 | Bultman |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0205264 | A1 | 9/2005 | Starr et al. |
| 2005/0205266 | A1 | 9/2005 | Todd et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2005/0279501 | A1 | 12/2005 | Surjaatmadja et al. |
| 2006/0012087 | A1 | 1/2006 | Matsuda et al. |
| 2006/0057479 | A1 | 3/2006 | Niimi et al. |
| 2006/0081378 | A1 | 4/2006 | Howard et al. |
| 2006/0102871 | A1 | 5/2006 | Wang et al. |
| 2006/0108126 | A1 | 5/2006 | Horn et al. |
| 2006/0116696 | A1 | 6/2006 | Odermatt et al. |
| 2006/0124310 | A1 | 6/2006 | Lopez de Cardenas |
| 2006/0124312 | A1 | 6/2006 | Rytlewski et al. |
| 2006/0131011 | A1 | 6/2006 | Lynde et al. |
| 2006/0131081 | A1 | 6/2006 | Mirchandani et al. |
| 2006/0144515 | A1 | 7/2006 | Tada et al. |
| 2006/0150770 | A1 | 7/2006 | Freim, III et al. |
| 2006/0151178 | A1 | 7/2006 | Howard et al. |
| 2006/0162927 | A1 | 7/2006 | Walker et al. |
| 2006/0213670 | A1 | 9/2006 | Bishop et al. |
| 2006/0231253 | A1 | 10/2006 | Vilela et al. |
| 2006/0283592 | A1 | 12/2006 | Sierra et al. |
| 2007/0017674 | A1 | 1/2007 | Blaisdell |
| 2007/0017675 | A1 | 1/2007 | Hammami et al. |
| 2007/0029082 | A1 | 2/2007 | Giroux et al. |
| 2007/0039741 | A1 | 2/2007 | Hailey |
| 2007/0044966 | A1 | 3/2007 | Davies et al. |
| 2007/0051521 | A1 | 3/2007 | Fike et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0074873 | A1 | 4/2007 | McKeachnie et al. |
| 2007/0102199 | A1 | 5/2007 | Smith et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0221373 | A1 | 9/2007 | Murray |
| 2007/0221384 | A1 | 9/2007 | Murray |
| 2007/0261862 | A1 | 11/2007 | Murray |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2007/0299510 | A1 | 12/2007 | Venkatraman et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0078553 | A1 | 4/2008 | George |
| 2008/0099209 | A1 | 5/2008 | Loretz et al. |
| 2008/0115932 | A1 | 5/2008 | Cooke |
| 2008/0149325 | A1 | 6/2008 | Crawford |

(56) References Cited

U.S. PATENT DOCUMENTS

| | | | |
|---|---|---|---|
| 2008/0149345 | A1 | 6/2008 | Bicerano |
| 2008/0169105 | A1 | 7/2008 | Williamson et al. |
| 2008/0179104 | A1 | 7/2008 | Zhang et al. |
| 2008/0202764 | A1 | 8/2008 | Clayton et al. |
| 2008/0202814 | A1 | 8/2008 | Lyons et al. |
| 2008/0223586 | A1 | 9/2008 | Barnett |
| 2008/0223587 | A1 | 9/2008 | Cherewyk |
| 2008/0236829 | A1 | 10/2008 | Lynde |
| 2008/0248205 | A1 | 10/2008 | Blanchet et al. |
| 2008/0277109 | A1 | 11/2008 | Vaidya |
| 2008/0277980 | A1 | 11/2008 | Koda et al. |
| 2008/0296024 | A1 | 12/2008 | Huang et al. |
| 2008/0314581 | A1 | 12/2008 | Brown |
| 2008/0314588 | A1 | 12/2008 | Langlais et al. |
| 2009/0044946 | A1 | 2/2009 | Schasteen et al. |
| 2009/0044949 | A1 | 2/2009 | King et al. |
| 2009/0050334 | A1 | 2/2009 | Marya et al. |
| 2009/0056934 | A1 | 3/2009 | Xu |
| 2009/0084553 | A1 | 4/2009 | Rytlewski et al. |
| 2009/0084556 | A1 | 4/2009 | Richards et al. |
| 2009/0107684 | A1 | 4/2009 | Cooke, Jr. |
| 2009/0145666 | A1 | 6/2009 | Radford et al. |
| 2009/0159289 | A1 | 6/2009 | Avant et al. |
| 2009/0178808 | A1 | 7/2009 | Williamson et al. |
| 2009/0194273 | A1 | 8/2009 | Surjaatmadja et al. |
| 2009/0205841 | A1 | 8/2009 | Kluge et al. |
| 2009/0226704 | A1 | 9/2009 | Kauppinen et al. |
| 2009/0242202 | A1 | 10/2009 | Rispler et al. |
| 2009/0242208 | A1 | 10/2009 | Bolding |
| 2009/0242214 | A1 | 10/2009 | Foster et al. |
| 2009/0255667 | A1 | 10/2009 | Clem et al. |
| 2009/0255684 | A1 | 10/2009 | Bolding |
| 2009/0255686 | A1 | 10/2009 | Richard et al. |
| 2009/0260817 | A1 | 10/2009 | Gambier et al. |
| 2009/0266548 | A1 | 10/2009 | Olsen et al. |
| 2009/0272544 | A1 | 11/2009 | Giroux et al. |
| 2009/0283270 | A1 | 11/2009 | Langeslag |
| 2009/0293672 | A1 | 12/2009 | Mirchandani et al. |
| 2009/0301730 | A1 | 12/2009 | Gweily |
| 2009/0308588 | A1* | 12/2009 | Howell et al. ..... 166/66.4 |
| 2009/0317556 | A1 | 12/2009 | Macary |
| 2010/0003536 | A1 | 1/2010 | Smith et al. |
| 2010/0012385 | A1 | 1/2010 | Drivdahl et al. |
| 2010/0025255 | A1 | 2/2010 | Su et al. |
| 2010/0032151 | A1 | 2/2010 | Duphorne |
| 2010/0044041 | A1 | 2/2010 | Smith et al. |
| 2010/0051278 | A1 | 3/2010 | Mytopher et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0122817 | A1 | 5/2010 | Surjaatmadja et al. |
| 2010/0139930 | A1 | 6/2010 | Patel et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0282338 | A1 | 11/2010 | Gerrard et al. |
| 2010/0294510 | A1 | 11/2010 | Holmes |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0056692 | A1 | 3/2011 | Lopez de Cardenas et al. |
| 2011/0056702 | A1 | 3/2011 | Sharma et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0100643 | A1 | 5/2011 | Themig et al. |
| 2011/0127044 | A1 | 6/2011 | Radford et al. |
| 2011/0132621 | A1 | 6/2011 | Agrawal et al. |
| 2011/0135953 | A1 | 6/2011 | Xu et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0214881 | A1 | 9/2011 | Newton et al. |
| 2011/0247833 | A1 | 10/2011 | Todd et al. |
| 2011/0253387 | A1 | 10/2011 | Ervin |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284240 | A1 | 11/2011 | Chen et al. |
| 2011/0284243 | A1 | 11/2011 | Frazier |
| 2012/0107590 | A1 | 5/2012 | Xu et al. |
| 2012/0118583 | A1 | 5/2012 | Johnson et al. |
| 2012/0130470 | A1 | 5/2012 | Agnew et al. |
| 2012/0168152 | A1 | 7/2012 | Casciaro |
| 2012/0211239 | A1 | 8/2012 | Kritzler et al. |
| 2012/0292053 | A1 | 11/2012 | Xu et al. |
| 2012/0318513 | A1 | 12/2012 | Mazyar et al. |
| 2013/0048304 | A1 | 2/2013 | Agrawal et al. |
| 2013/0105159 | A1 | 5/2013 | Alvarez |
| 2013/0133897 | A1 | 5/2013 | Baihly et al. |

FOREIGN PATENT DOCUMENTS

| | | | |
|---|---|---|---|
| CN | 1076968 | A | 10/1993 |
| CN | 1255879 | A | 6/2000 |
| CN | 101457321 | B | 6/2010 |
| EP | 1857570 | A2 | 11/2007 |
| GB | 912956 | | 12/1962 |
| JP | 61067770 | | 4/1986 |
| JP | 7-54008 | A | 2/1995 |
| JP | 08232029 | | 9/1996 |
| JP | 08-232029 | A1 | 10/1996 |
| JP | 2010502840 | A | 1/2010 |
| KR | 95-0014350 | A | 11/1995 |
| WO | 2008079485 | | 7/2008 |
| WO | 2009079745 | A1 | 7/2009 |
| WO | 2011071902 | A3 | 6/2011 |
| WO | 2011071910 | A3 | 6/2011 |

OTHER PUBLICATIONS

Chang, et al.; "Electrodeposition of Aluminum on Magnesium Alloy in Aluminum Chloride (A1C13)-1-ethy1-3-methylimidazolium chloride (EMIC) Ionic Liquid and Its Corrosion Behavior"; Electrochemistry Communications; 9; pp. 1602-1606; (2007).

Forsyth, et al.; "An Ionic Liquid Surface Treatment for Corrosion Protection of Magnesium Alloy AZ31"; Electrochem. Solid-State Lett./ 9(11); Abstract only; 1 page.

Forsyth, et al.; "Exploring Corrosion Protection of Mg Via Ionic Liquid Pretreatment"; Surface & Coatings Technology; 201; pp. 4496-4504; (2007).

Hsiao et al.; "Effect of Heat Treatment on Anodization and Electrochemical Behavior of AZ91D Magnesium Alloy"; J. Mater. Res.; 20(10); pp. 2763-2771;(2005).

Hsiao, et al.; "Anodization of AZ91D Magnesium Alloy in Silicate-Containing Electrolytes"; Surface & Coatings Technology; 199; pp. 127-134; (2005).

Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).

Hsiao, et al.; "Characterization of Anodic Films Formed on AZ91D Magnesium Alloy"; Surface & Coatings Technology; 190; pp. 299-308; (2005).

Huo et al.; "Corrosion of AZ91D Magnesium Alloy with a Chemical Conversion Coating and Electroless Nickel Layer"; Corrosion Science: 46; pp. 1467-1477; (2004).

Liu, et al.; "Electroless Nickel Plating on AZ91 Mg Alloy Substrate"; Surface & Coatings Technology; 200; pp. 5087-5093; (2006).

Lunder et al.; "The Role of Mg17Al12 Phase in the Corrosion of Mg Alloy AZ91"; Corrosion; 45(9); pp. 741-748; (1989).

Pardo, et al.; "Corrosion Behaviour of Magnesium/Aluminium Alloys in 3.5 wt% NaC1"; Corrosion Science; 50; pp. 823-834; (2008).

Shi et al.; "Influence of the Beta Phase on the Corrosion Performance of Anodised Coatings on Magnesium-Aluminium Alloys"; Corrosion Science; 47; pp. 2760-2777; (2005).

(56) References Cited

OTHER PUBLICATIONS

Song, et al.; "Corrosion Mechanisms of Magnesium Alloys"; Advanced Engineering Materials; 1(1); pp. 11-33; (1999).
Song, Guangling; "Recent Progress in Corrosion and Protection of Magnesium Alloys"; Advanced Engineering Materials; 7(7); pp. 563-586; (2005).
Song, et al.; "Influence of Microstructure on the Corrosion of Diecast AZ91D"; Corrosion Science; 41; pp. 249-273; (1999).
Song, et al.; "Corrosion Behaviour of AZ21, AZ501 and AZ91 in Sodium Chloride"; Corrosion Science; 40(10); pp. 1769-1791; (1998).
Song, et al.; "Understanding Magnesium Corrosion"; Advanced Engineering Materials; 5; No. 12; pp. 837-858; (2003).
Zhang, et al; "Study on the Environmentally Friendly Anodizing of AZ91D Magnesium Alloy"; Surface and Coatings Technology: 161; pp. 36-43; (2002).
Chun-Lin, Li. "Design of Abrasive Water Jet Perforation and Hydraulic Fracturing Tool," Oil Field Equipment, Mar. 2011.
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
Notification of Transmittal of The International Search Report and the Written Opinion of the International Searching Authority; PCT/US2010/059257; Korean Intellectual Property Office; Mailed Jul. 27, 2011.
Flow Control Systems, [online]; [retrieved on May 20, 2010]; retrieved from the Internet http://www.bakerhughes.com/products-and-services/completions-and-productions/well-completions/packers-and-flow-control/flow-control-systems.
Optisleeve Sliding Sleeve, [online]; [retrieved on Jun. 25, 2010]; retrieved from the Internet weatherford.com/weatherford/groups/.../weatherfordcorp/WFT033159.pdf.
"Sliding Sleeve", Omega Completion Technology Ltd, Sep. 29, 2009, retrieved on: www.omega-completion.com.
Welch, William R. et al., "Nonelastomeric Sliding Sleeve Maintains Long Term Integrity in HP/HT Application: Case Histories." [Abstract Only], SPE Eastern Regional Meeting, Oct. 23-25, 1996, Columbus. Ohio.
Elsayed Ayman, Imai Hisashi, Umeda Junko and Kondoh Katsuyoshi, "Effect of Consolidation and Extrusion Temperatures on Tensile Properties of Hot Extruded ZK61 Magnesium Alloy Gas Atomized Powders via Spark Plasma Sintering" Transacation of JWRI, vol. 38, (2009) No. 2, pp. 31-35.
Bing Q. Han, Enrique J. Lavernia and Farghalli A. Mohamed, "Mechanical Properties of Nanostructured Materials", Rev. Adv. Mater. Sci. 9(2005) 1-16.
Adam J. Maisano, "Cryomilling of Aluminum-Based and Magnesium-Based Metal Powders", Thesis, Virginia Tech, Jan. 13, 2006.
E.J. Lavenia, B.Q. Han, J.M. Schoenung: "Cryomilled nanostructured materials: Processing and properties", Materials Science and Engineering A, 493, (2008) 207-214.
H. Watanabe, T. Mukai, M. Mabuchi and K. Higashi, "Superplastic Deformation Mechanism in Powder Metallurgy Magnesium Alloys and Composites", Acta mater. 49 (2001) pp. 2027-2037.
Constantine, Jesse. "Selective Production of Horizontal Openhole Completions Using ECP and Sliding Sleeve Technology." SPE Rocky Mountain Regional Meeting, May 15-18, 1999, Gillette, Wyoming. [Abstract Only].
H. Watarai, Trend of research and development for magnesium alloys-reducing the weight of structural materials in motor vehicles, (2006) Science and technology trends, Quaterly review No. 18, 84-97.
M. Bououdina, Z. X. Guo, Comparative study of mechanical alloying of (Mg+Al) and (Mg+Al+Ni) mixtures for hydrogen storage, J. Alloys, Compds, 2002, 336, 222-231.
M.Liu, P.J. Uggowitzer, A.V. Nagasekhar, P. Schmutz, M. Easton, G.L. Song, A. Atrens, Calculated phase diagrams and the corrosion of die-cast Mg—Al alloys, Corrosion Science, 2009, 51, 606-619.
International Search Report and Written Opinion; International Application No. PCT/US2012/038622; International Filing Date: May 18, 2012; Date of Mailing Dec. 6, 2012; 12 pages.
S.L. Lee, C.W. Hsu, F.K. Hsu, C.Y. Chou, C.k. Lin, C.W. Weng, Effects of Ni addition on hydrogen storage properties of Mg17AL12alloy, Materials Chemistry and Physics, 2011, 126, 319-324.
Shumbera et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003, Denver, Colorado. [Abstract Only].
T.J. Bastow, S. Celotto, Clustering and formation of nano-precipitates in dilute aluminum and magnesium alloys, Materials science and Engineering, 2003, C23, 757-762.
Vickery, Harold and Christian Bayne, "New One-Trip Multi-Zone Frac Pack System with Positive Positioning." European Petroleum Conference, Oct. 29-31, 2002, Aberdeen, UK. [Abstract Only].
Baker Oil Tools. "Z-Seal Metal-to-Metal Expandable Sealing Device Uses Expanding Metal in Place of Elastomers," Nov. 6, 2006.
International Search Report and Written Opinion for PCT Application No. PCT1US20121044866, dated Jan. 2, 2013, pp. 1-9.
International Search Report and Written Opinion, PCT/US2012/046231, Date of Mailing Jan. 29, 2013, Korean Intellectual Property Office, Written Opinion 6 pages, International Search Report 3 pages.
International Search Report and Written Opinion, International Application No. PCT/US20121049434, Date of Mailing Feb. 1, 2013, Korean Intellectual Property Office, Written Opinion 4 pages, International Search Report 3 pages.
Notification of Transmittal of the International Search Report and the Written Opinion of the International Searching Authority; PCT/US20101059259; International Searching Authority KIPO; Mailed Jun. 13, 2011.
International Search Report and Written Opinion, PCT/US2010/059263, dated Jul. 8, 2011.
Notification of Transmittal of the International Search Report and the Written Opinion of the International Searching Authority; PCT/US20101059265; International Searching Authority KIPO; Mailed Jun. 16, 2011.
Notification of Transmittal of the International Search Report and the Written Opinion of the International Searching Authority; PCT/US20101059268; International Searching Authority KIPO; Mailed Jun. 17, 2011.
Notification of Transmittal of the International Search Report and the Written Opinion of the International Searching Authority, or the Declaration mailed on Feb. 23, 2012 (Dated Feb. 22, 2012) for PCT/US2011/043036.
Notification of Transmittal of the International Search Report and the Written Opinion of the International Searching Authority; PCT/US2011/047000; Korean Intellectual Property Office; Mailed Dec. 26, 2011; 8 pages.
International Search Report and Written Opinion of the International Searching Authority for International Application No. PCT/US2011/058099 (filed on Oct. 27, 2011), mailed on May 11, 2012.
International Search Report and Written Opinion of the International Searching Authority, or the Declaration for PCT/US2011/058105 mailed from the Korean Intellectual Property Office on May 1, 2012.
International Search Report and Written Opinion for International application no. PCT/US2012/034973 filed on Apr. 25, 2012, mailed on Nov. 29, 2012.
Patent Cooperation Treaty International Search Report and Written Opinion for International Patent Application No. PCT/US2012/034978 filed on Apr. 25, 2012, mailed on Nov. 12, 2012.
International Search Report and Written Opinion; PCT/US2012/038622; Dated Dec. 6, 2012; 12 pages.

* cited by examiner

SELECTIVE HYDRAULIC FRACTURING TOOL AND METHOD THEREOF

BACKGROUND

In the drilling and completion industry, the formation of boreholes for the purpose of production or injection of fluids is common. The boreholes are used for exploration or extraction of natural resources such as hydrocarbons, oil, gas, water, and CO2 sequestration. For enhancing production and increasing extraction rates from a subterranean borehole, the formation walls of the borehole may be fractured using a pressurized slurry, proppant containing fracturing fluid, or other treating fluids. The fractures in the formation wall may be held open with the particulates once the injection of fracturing fluids has ceased.

A conventional fracturing system passes pressurized fracturing fluid through a tubular string that extends downhole through the borehole that traverses the zones to be fractured. The string may include valves that are opened to allow for the fracturing fluid to be directed towards a targeted zone. To remotely open the valves from the surface, a ball is dropped into the string and lands on a ball seat associated with a particular valve to block fluid flow through the string and consequently build up pressure uphole of the ball which forces a sleeve downhole thus opening a port in the wall of the string. When multiple zones are involved, the ball seats are of varying sizes with a downhole most seat being the smallest and an uphole most seat being the largest, such that balls of increasing diameter are sequentially dropped into the string to sequentially open the valves from the downhole end to an uphole end. Thus, the zones of the borehole are fractured in a "bottom-up" approach by starting with fracturing a downhole-most zone and working upwards towards an uphole-most zone.

To avoid the inevitable complications associated with employing differently sized ball seats, the smallest of which may overly restrict the flow through the string, and correspondingly different sized balls, the use of deformable balls and ball seats has been proposed, however the rate at which the balls are forced through the ball seats introduces additional complexities including dealing with different rates of deformation of the selected material since it may not function as desired in downhole environments. Also, despite providing certain advantages over using differently sized balls, the order of fracturing operations is still limited to the "bottom-up" approach.

BRIEF DESCRIPTION

A selective downhole tool includes a tubular having a longitudinal bore enabling passage of fluids there through and having a valve opening in a wall of the tubular; an expandable ball seat selectively movable between a first size sized to trap a ball to block flow through the tubular and a larger second size sized to release the ball through the tubular; and a valve cover longitudinally movable within the tubular, the valve cover including a dissolvable insert.

A method of operating a downhole tool, the method includes running the downhole tool in a bore hole, the tool including a tubular having a valve opening covered by a valve cover; moving the valve cover longitudinally to expose the valve opening; recovering the valve opening with the valve cover subsequent an operation through the valve opening; and dissolving a portion of the valve cover to re-expose the valve opening.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 10:
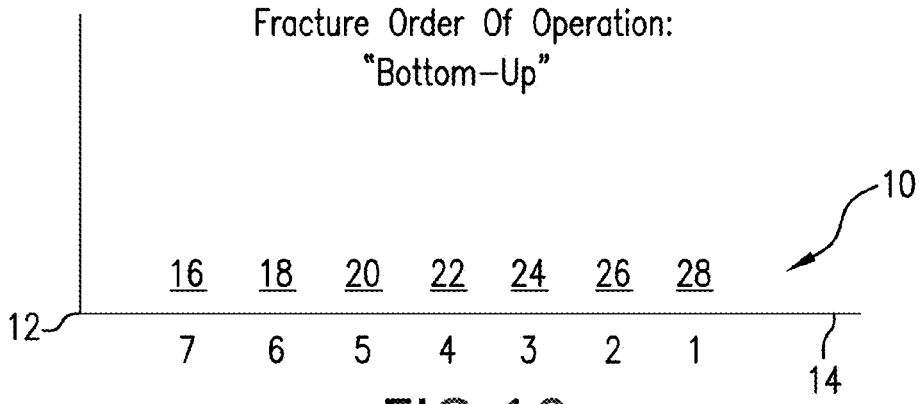
FIG.10 PRIOR ART
FIG. 10 depicts a schematic view of a fracture order of operation according to the prior art and achievable with the selective hydraulic fracturing tool.
Figure 11:
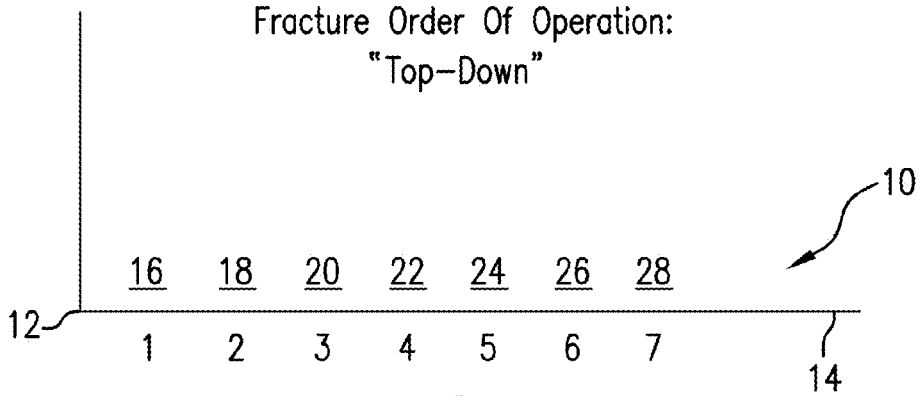
FIG. 11 depicts a schematic view of an exemplary embodiment of another fracture order of operation achievable with the selective hydraulic fracturing tool.
Figure 12:
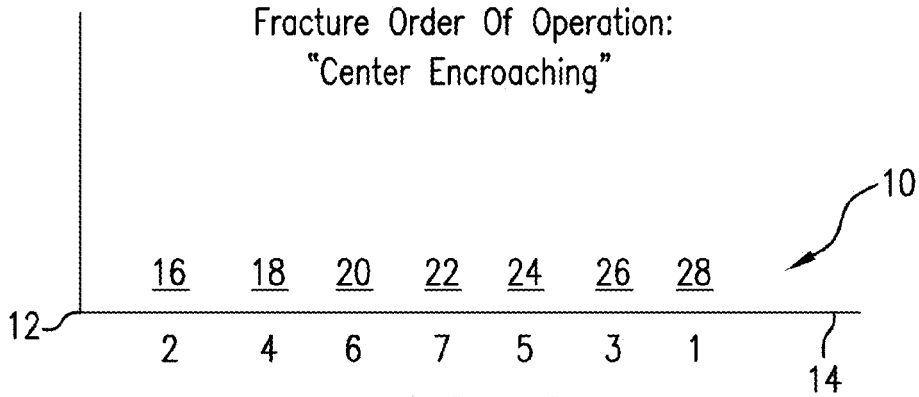
FIG. 12 depicts a schematic view of an exemplary embodiment of still another fracture order of operation achievable with the selective hydraulic fracturing tool.

A selective hydraulic fracturing tool 100, shown in FIGS. 1, 4, 6, and 8 and method is disclosed herein to fracture a borehole 10, schematically shown in FIGS. 10-12, in multiple configurations including "top-down", "bottom-up", and "center-encroaching". While previous tools and methods have been limited to the "bottom-up" approach to fracturing a borehole as shown in FIG. 10 by starting with small diameter balls and working uphole with consecutively larger balls, the selective hydraulic fracturing tool 100 provides a monobore solution enabling a variety of fracturing orders to be accomplished therewith.

Figures 1, 3:
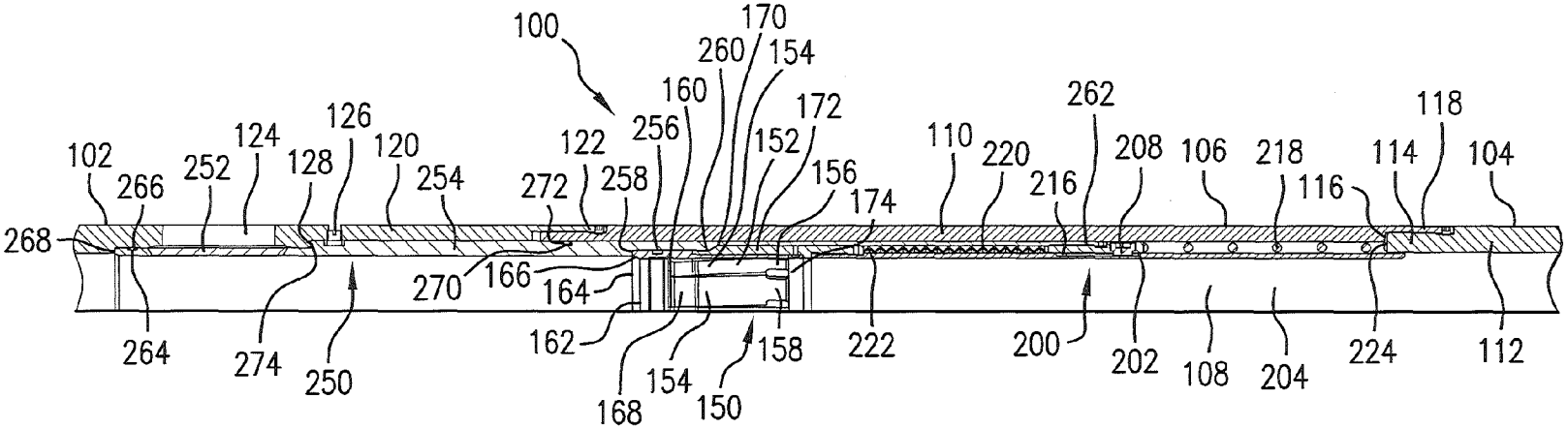
FIG. 1 depicts a cross-sectional view of an exemplary embodiment of a selective hydraulic fracturing tool in a run-in position.
FIG. 3 depicts a schematic view of an exemplary embodiment of a portion of an indexing path and indexing pin for the position of the selective hydraulic fracturing tool of FIG. 1.

An exemplary embodiment of the selective hydraulic fracturing tool 100 is shown in FIG. 1 in a "run-in" position for running the tool 100 into a borehole. While the tool 100 is described as a fracturing tool, the tool 100 may be employed for performing alternative operations and tasks in a borehole. For the purposes of description, the tool 100 includes an uphole end 102 and a downhole end 104, although it should be understood that the uphole end 102 may not necessarily be the uphole-most end of the tool 100 and the downhole end 104 may not necessarily be the downhole-most end of the tool 100, as the downhole end 104 and/or the uphole end 102 may be connected to another section of the tool 100 that includes additional repetitive features as those shown in FIG. 1 for fracturing additional zones, or may be connected to tubing joints, tubing extensions, or other downhole tool portions not shown. The tool includes a tubular body 106 having a bore 108 centrally located therein and running axially there through for the flow of materials such as, but not limited to, fracturing fluids, production fluids, etc.

The tool includes an expandable ball seat 150 that allows an operator to use a single sized ball for all zones, and thus provides for a mono-bore operation that allows both improved simplicity in manufacturing the tool 100 as well as improved simplicity in operation. While a spherical ball is typically employed in such an operation, the term ball includes any shaped object which can be dropped into the bore 108 and be trapped and subsequently released from the ball seat 150. A j-mechanism indexing apparatus 200 provides alternate positions for the ball seat 150 to be located in and allows balls to pass through the ball seat 150 without shearing/activating the tool 100. A valve cover 250 includes dissolvable material that allows an insert 252 to close off a fractured zone and then dissolve, without intervention, to allow production from the zone after the borehole 10 is completed.

Figure 2B:
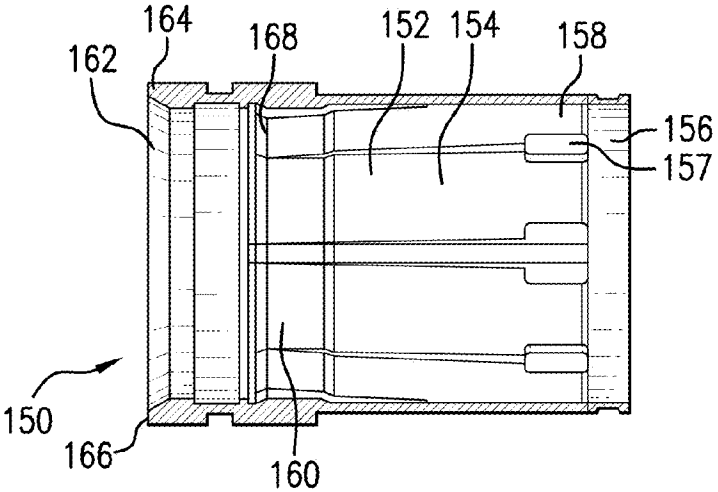
FIGS. 2A-2C depict perspective and cross-sectional views of an exemplary embodiment of a ball seat for use within the selective hydraulic fracturing tool of FIG. 1.
Figure 2C:
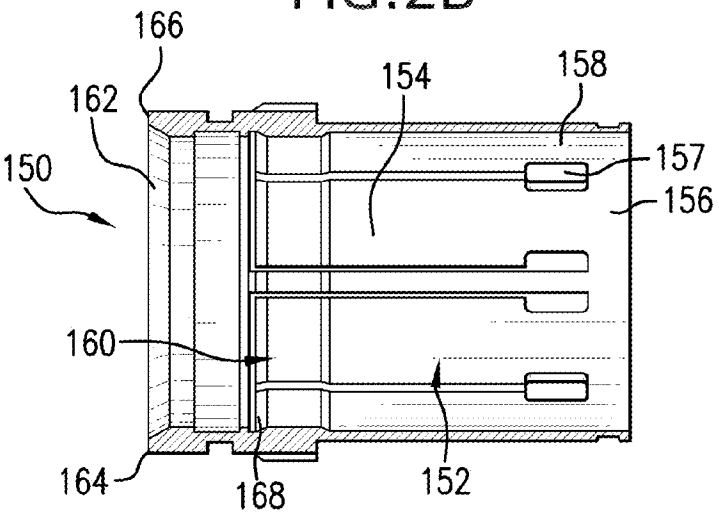
Figure 2A:
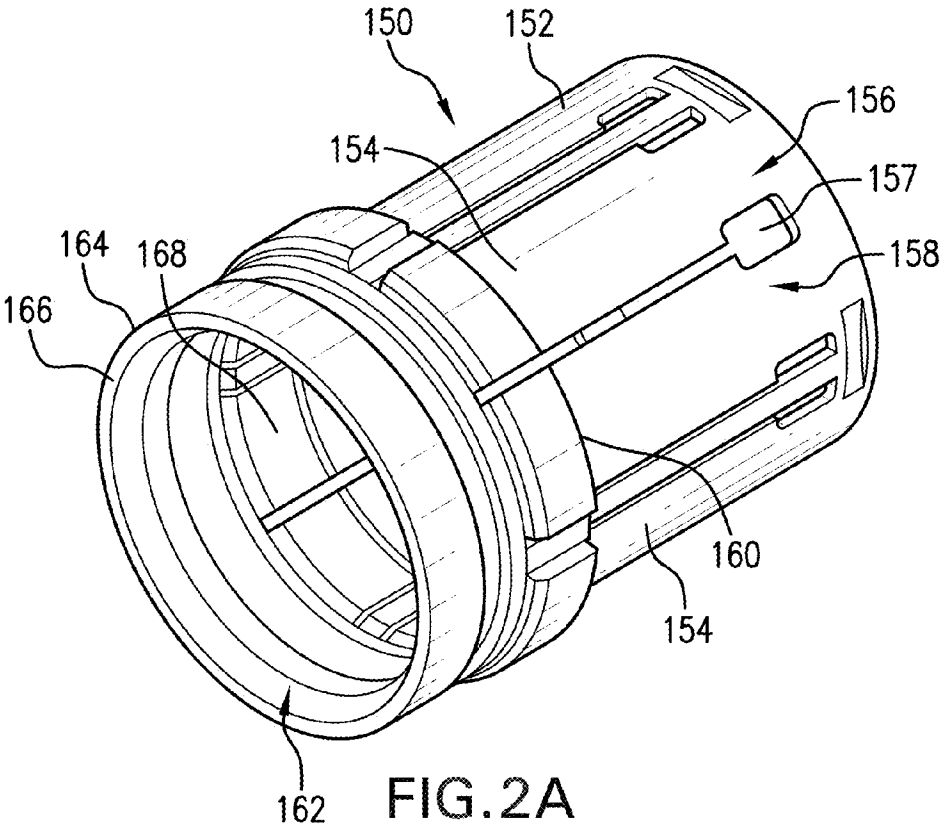
Figure 6:
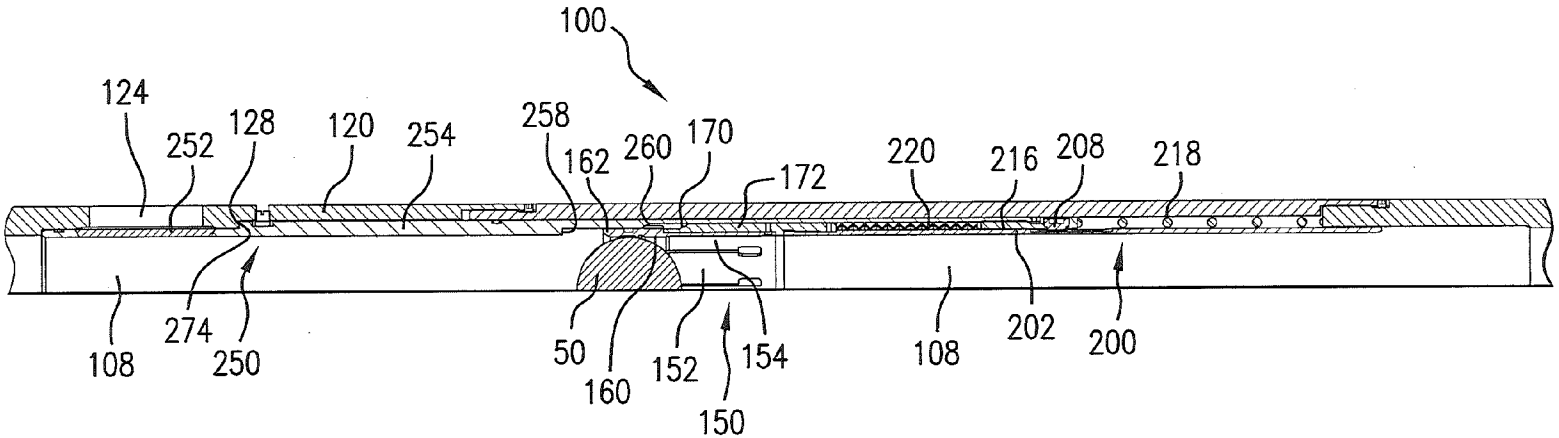
FIG. 6 depicts a cross-sectional view of the selective hydraulic fracturing tool of FIG. 1 with a ball seat expanded.
Figure 7:
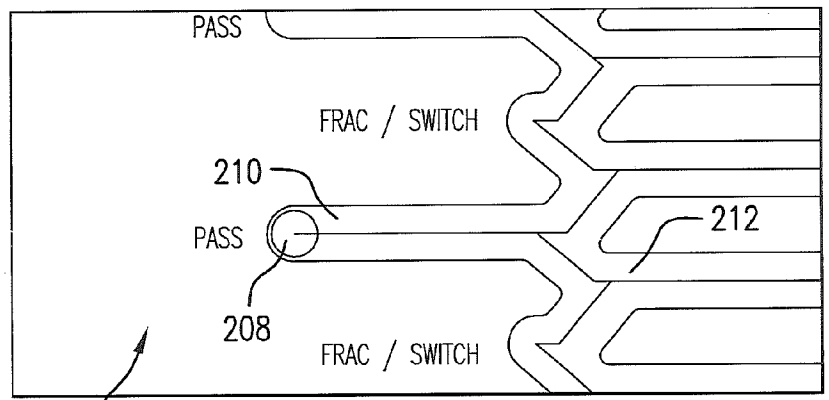
FIG. 7 depicts a schematic view of the portion of the indexing path and indexing pin for the position of the selective hydraulic fracturing tool of FIG. 6.

In an exemplary embodiment of the expandable ball seat 150, a collet 152 including a plurality of fingers 154 is engaged with the indexing apparatus 200. The ball seat 150 is shown by itself in FIGS. 2A-2C. The fingers 154 extend longitudinally from a base 156 which may be integrally attached to a fixed end 158 of the fingers 154. Openings 157 are provided near the fixed ends 158 of the fingers 154 to provide flexibility to the fingers 154. The free ends 160 of the fingers 154 are radially movable relative to the base 156 from a first condition in which the free ends 160 of the fingers 154 collapse slightly inward to provide a reduced first diameter as shown in FIG. 1 and FIG. 2B to a second condition in which the free ends 160 of the fingers 154 are biased back to an uncompressed condition to provide an increased second diameter as shown in FIG. 6 and FIG. 2C. As can be understood, in operation of the tool 100, a ball 50 having a diameter that becomes trapped in the ball seat 150 when the collet 152 is in the first condition, and passable through the ball seat 150 when the collet 152 is in the second condition is used in conjunction with the tool 100. The ball seat 150 further includes a funnel shaped portion 162 for guiding the ball 50 into the ball seat 150 and towards the free ends 160 of the fingers 154. The funnel shaped portion 162 may be sealed relative to a valve sleeve 254 of the valve cover 250 using a seal 256 such as an O-ring. An uphole end 164 of the funnel shaped portion 162 includes a shoulder 166 that abuts with a ledge 258 of the valve sleeve 254. Downhole of the funnel shaped portion 162, the free ends 160 of the fingers 154 may also include inclined surfaces 168 that flare outwardly towards the uphole end 102 of the tool 100 for accepting the ball 50 within the collet 152. When compressed together, the inclined surfaces 168 of the fingers 154 form a funnel shape that receives the ball 50 therein. The free ends 160 of the fingers 154 may be compressed together in the first condition by the ramped surface 260 of the valve sleeve 254

While a collet 152 has been described for forming the expandable ball seat 150, an alternative exemplary embodiment of an expandable ball seat may include a split ring or "C" ring where movement of the indexing apparatus 200, or a feature connected to the indexing apparatus 200, between the body 106 and the ring will force the ring to be compressed to thereby reduce an inner diameter of the ring thus preventing a ball 50 from passing there through until movement of the indexing apparatus 200 away from the ring opens the ring to increase the aperture size of the ring allowing for passage of the ball 50.

In an exemplary embodiment of the j-mechanism indexing apparatus 200, the apparatus 200 includes an indexing sleeve 202 having a central longitudinal aperture 204 for fluid flow, where the aperture 204 passes through the bore 108 of the tubular body 106. The sleeve 202 also includes an indexing path 206, such as a groove, that is formed about a diameter of the sleeve 202. A portion of the indexing path 206 is shown in FIGS. 3, 5, 7, and 9, although it should be understood that the path 206 may be formed non-stop about the perimeter of the sleeve 202 for an indexing pin 208 to pass. The path 206 includes first sections 210 that are extended longitudinal uphole portions, second sections 212 that are extended longitudinal downhole portions, two for every first section 210, and third sections 214 that are slightly protruding longitudinal uphole portions interposed between the first sections 210, where the third sections 214 connect two adjacent second sections 212. The uphole ends 226, 228 of the first and third sections 210, 214 are stopping points which bias the indexing pin 208 to remain therein until purposely removed therefrom. The indexing pin 208 passes through the first, second, and third sections 210, 212, 214 while attached to a movable tubular section 216 trapped between the indexing sleeve 202 and an outer middle body portion 110 of the tool 100. Multiple indexing pins 208 may be employed to distribute the load about the body 106, in which case each indexing pin 208 would be located in either a first, second, or third section 210, 212, 214 at relatively the same time as the other pins 208 depending on the stage of the tool 100. A compression spring 218 surrounds the indexing sleeve 202 and is located downhole of the indexing pin 208 to bias the indexing pin 208 relative to the indexing sleeve 202, and a spring member 220 uphole of the indexing pin 208 and the movable tubular section 216 also surrounds the indexing sleeve 202. The uphole end 222 of the spring member 220 abuts with the inner tubular 172 that includes the ramped surface 170. The spring member 220 and compression spring 218 may include a series of alternatingly stacked spring washers. Also, although depicted differently, the compression spring 218 and the spring member 220 may be any form of spring that works in compression.

The outer middle body portion 110 of the tool 100 is connected to a downhole body portion 112 of the tool 100. The downhole body portion 112 of the tool 100 includes an indented section 114 that includes an uphole surface 116 that contacts a downhole end 224 of the compression spring 218. The indented section 114 of the downhole body portion 112 is attached to a downhole end 118 of the middle body portion 110, where the middle body portion is indented to match and overlap the indented section 114 of the downhole body portion 112. A downhole end 262 of the valve sleeve 254 is fixedly attached to the movable tubular section 216 and therefore surrounds the spring member 220, ball seat 150, and inner tubular 172. An uphole body portion 120 of the tool 100 surrounds an uphole portion of the valve sleeve 254. The downhole end 122 of the uphole body portion 120 is connected to the outer middle body portion 110. The uphole body portion 120 includes a valve opening 124 for allowing a fracturing operation to occur by allowing the passage of fracturing fluids there through. The valve opening 124 may also be used for the passage of production fluids or other downhole operations. The uphole body portion 120 is connected to the valve sleeve 254 by a shear pin 126.

In an exemplary embodiment of the valve cover 250, the valve cover 250 includes the valve sleeve 254 as previously described as connected via a shear pin 126 to the uphole body portion 120 and connected to the movable tubular section 216 at the downhole end 262 of the valve sleeve 254. An indent 264 for a seal 266 is provided at an uphole end 268 of the valve sleeve 254, and an indent 270 for a seal 272 is provided at a central area of the valve sleeve 254. The valve cover 250 also includes the dissolvable insert 252 made of a dissolvable material, and the insert 252 is located downhole of the seal 266 provided at the uphole end 268 of the valve sleeve 254. In a run-in position, as shown in FIG. 1, the insert 252 is aligned with the valve opening 124 to prevent access to any zones. The seals 266, 272 further insure that any fluids pumped through the bore 108 do not exit the tool 100 until intended. An outer perimeter of the dissolvable insert 252 is larger than an outer perimeter of the valve opening 124, and may have an oval or rectangular slotted shape, circular, rectangular, or oval shape, or any other shape deemed necessary for a fracturing operation or other downhole operation. The dissolvable insert 252 and/or the valve cover 250 may include engagement features to retain the dissolvable insert 252 in place within the valve cover 250 until it is dissolved. Such engagement features may include, but are not limited to, any number of lips, tongue and grooves, ledges, meshing teeth perimeters, etc. Additional features such as pins and bonding materials may also be employed. Alternatively, or additionally, the material of the dissolvable insert 252 may be directly molded within the opening of the valve cover 250 such that the dissolvable insert 252 is bonded to the valve cover 250 until the dissolvable inert 252 is dissolved.

Figure 13:
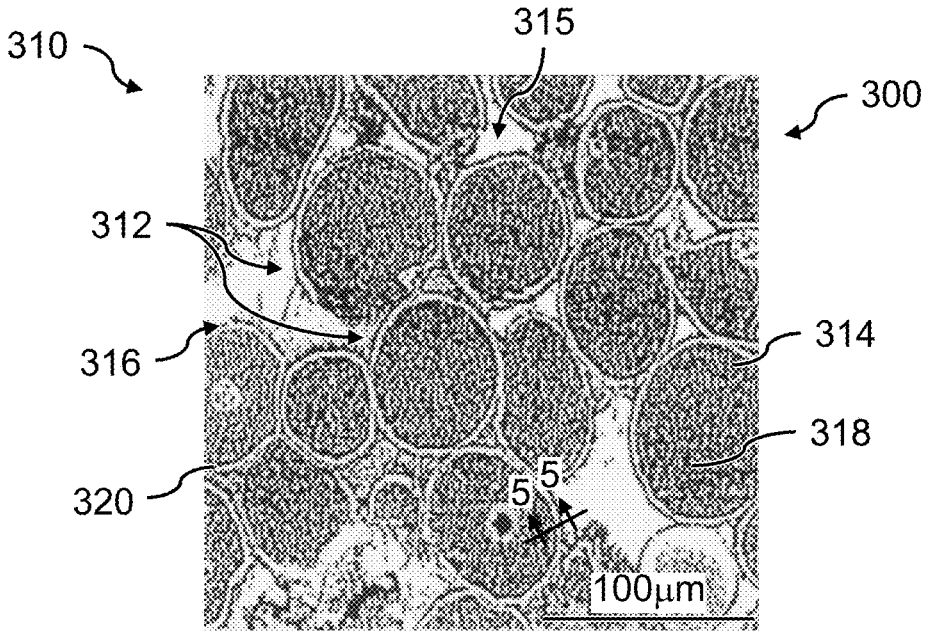
FIG. 13 is a photomicrograph of a powder 310 as disclosed herein that has been embedded in a potting material and sectioned.

United States Patent Publication No. 2011/0135953 (Xu, et al.) is hereby incorporated by reference in its entirety. The dissolvable material of the insert 252 may include a controlled electrolytic metallic material 300, as shown in FIG. 13, such as CEM™ material available from Baker Hughes Inc. The material 300 is used as the dissolvable inserts 252 to close off a zone after fracking and allow other zones to be fracked without leaking into previous zones. After all of the zones have been fracked, the material 300 can be dissolved away with exposure to certain chemicals, leaving an aperture in the valve sleeve 254, and thus allow production from all of the previously fracked zones. The dissolvable inserts 252 incorporate the degradable material 300 in the form of a barrier, block, or layer at least partially blocking or obstructing the aperture in the valve sleeve 254. Material 300 is initially at least partially blocking/obstructing the aperture. The material 300 will then corrode, dissolve, degrade, or otherwise be removed based upon exposure to a fluid in contact therewith. Generally, as used herein, the term "degradable" shall be used to mean able to corrode, dissolve, degrade, disperse, or otherwise be removed or eliminated, while "degrading" or "degrade" will likewise describe that the material is corroding, dissolving, dispersing, or otherwise being removed or eliminated. Any other form of "degrade" shall incorporate this meaning. The fluid may be a natural borehole fluid such as water, oil, etc. or may be a fluid added to the borehole for the specific purpose of degrading the material 300. Material 300 may be constructed of a number of materials that are degradable as noted above, but one embodiment in particular utilizes a high degradable magnesium based material having a selectively tailorable degradation rate and or yield strength. The material itself is discussed in detail later in this disclosure. This material exhibits exceptional strength while intact and yet easily degrades in a controlled manner and selectively short time frame. The material is degradable in water, water-based mud, downhole brines or acid, for example, at a selected rate as desired (as noted above). In addition, surface irregularities to increase a surface area of the material 300 that is exposed to the degradation fluid such as grooves, corrugations, depressions, etc. may be used. During degradation of the material 300, the aperture in the valve sleeve 254 may be opened, unblocked, created, and/or enlarged. Because the material 300 disclosed above can be tailored to completely degrade the material in about 4 to 10 minutes, the apertures can be opened, unblocked, created, and/or enlarged virtually immediately as necessary. Even if initially completely blocked by degradable material 300, the apertures in the valve sleeve 254 are still considered and referred to as apertures because the degradable material 300 of the dissolvable inserts 252 is intended to be removed.

The materials 300 in the dissolvable inserts 252 as described herein are lightweight, high-strength metallic materials. These lightweight, high-strength and selectably and controllably degradable materials 300 include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. These powder compacts provide a unique and advantageous combination of mechanical strength properties, such as compression and shear strength, low density and selectable and controllable corrosion properties, particularly rapid and controlled dissolution in various borehole fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a borehole proximate the dissolvable inserts 252 formed from the compact, including a property change in a borehole fluid that is in contact with the powder compact. The selectable and controllable degradation or disposal characteristics described also allow the dimensional stability and strength of the dissolvable inserts 252 made from these materials to be maintained until they are no longer needed, at which time a predetermined environmental condition, such as a borehole condition, including borehole fluid temperature, pressure or pH value, may be changed to promote their removal by rapid dissolution. These coated powder materials and powder compacts and engineered materials formed from them, as well as methods of making them, are described further below.

Referring to FIGS. 13-18, further specifics regarding material 300 can be gleaned. In FIG. 13, a metallic powder 310 includes a plurality of metallic, coated powder particles 312. Powder particles 312 may be formed to provide a powder 310, including free-flowing powder, that may be poured or otherwise disposed in all manner of forms or molds (not shown) having all manner of shapes and sizes and that may be used to fashion precursor powder compacts and powder compacts 400 (FIGS. 15 and 16), as described herein, that may be used as, or for use in manufacturing, various articles of manufacture, including the dissolvable inserts 252.

Each of the metallic, coated powder particles 312 of powder 310 includes a particle core 314 and a metallic coating layer 316 disposed on the particle core 314. The particle core 314 includes a core material 318. The core material 318 may include any suitable material for forming the particle core 314 that provides powder particle 312 that can be sintered to form a lightweight, high-strength powder compact 400 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common borehole fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 318 may also include other metals that are less electrochemically active than Zn or non-metallic materials, or a combination thereof. Suitable non-metallic materials include ceramics, composites, glasses or carbon, or a combination thereof. Core material 318 may be selected to provide a high dissolution rate in a predetermined borehole fluid, but may also be selected to provide a relatively low dissolution rate, including zero dissolution, where dissolution of the nanomatrix material causes the particle core 314 to be rapidly undermined and liberated from the particle compact at the interface with the borehole fluid, such that the effective rate of dissolution of particle compacts made using particle cores 314 of these core materials 318 is high, even though core material 318 itself may have a low dissolution rate, including core materials 318 that may be substantially insoluble in the borehole fluid.

With regard to the electrochemically active metals as core materials 318, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 318 may also include other constituents, including various alloying additions, to alter one or more properties of the particle cores 314, such as by improving the strength, lowering the density or altering the dissolution characteristics of the core material 318.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 314 and core material 318, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 314 and core material 318 have a melting temperature ($T_P$). As used herein, $T_P$ includes the lowest temperature at which incipient melting or liquation or other forms of partial melting occur within core material 318, regardless of whether core material 318 comprises a pure metal, an alloy with multiple phases having different melting temperatures or a composite of materials having different melting temperatures.

Particle cores 314 may have any suitable particle size or range of particle sizes or distribution of particle sizes. For example, the particle cores 314 may be selected to provide an average particle size that is represented by a normal or Gaussian type unimodal distribution around an average or mean, as illustrated generally in FIG. 13. In another example, particle cores 314 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 315 of the particles 312 of powder 310. In an exemplary embodiment, the particle cores 314 may have a unimodal distribution and an average particle diameter of about 5 μm to about 300 μm, more particularly about 80 μm to about 120 μm, and even more particularly about 100 μm.

Particle cores 314 may have any suitable particle shape, including any regular or irregular geometric shape, or combination thereof. In an exemplary embodiment, particle cores 314 are substantially spheroidal electrochemically active metal particles. In another exemplary embodiment, particle cores 314 are substantially irregularly shaped ceramic particles. In yet another exemplary embodiment, particle cores 314 are carbon or other nanotube structures or hollow glass microspheres.

Figure 14:
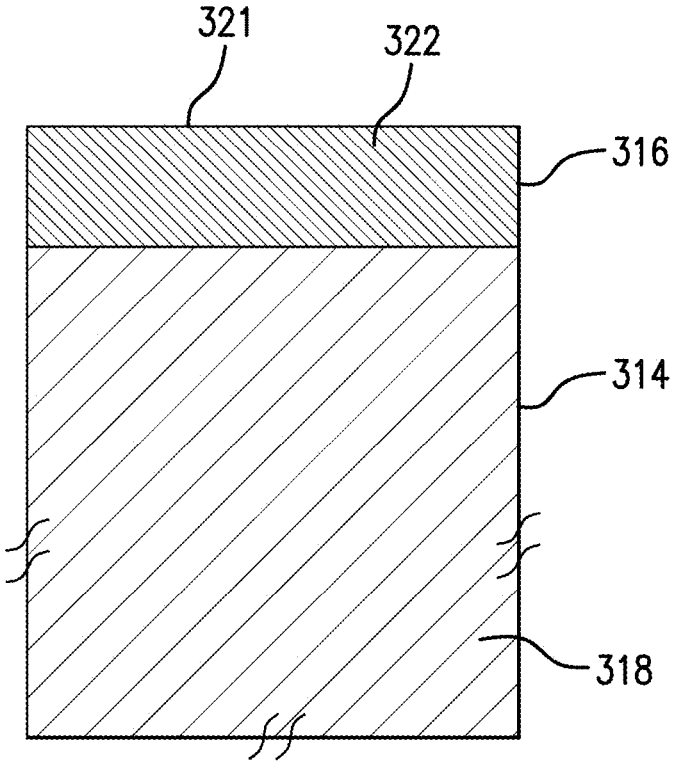
FIG. 14 is a schematic illustration of an exemplary embodiment of a powder particle 312 as it would appear in an exemplary section view represented by section 5-5 of FIG. 13.

Each of the metallic, coated powder particles 312 of powder 310 also includes a metallic coating layer 316 that is disposed on particle core 314. Metallic coating layer 316 includes a metallic coating material 320. Metallic coating material 320 gives the powder particles 312 and powder 310 its metallic nature. Metallic coating layer 316 is a nanoscale coating layer. In an exemplary embodiment, metallic coating layer 316 may have a thickness of about 25 nm to about 2500 nm. The thickness of metallic coating layer 316 may vary over the surface of particle core 314, but will preferably have a substantially uniform thickness over the surface of particle core 314. Metallic coating layer 316 may include a single layer, as illustrated in FIG. 14, or a plurality of layers as a multilayer coating structure. In a single layer coating, or in each of the layers of a multilayer coating, the metallic coating layer 316 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 316, each of the respective layers, or combinations of them, may be used to provide a predetermined property to the powder particle 312 or a sintered powder compact formed therefrom. For example, the predetermined property may include the bond strength of the metallurgical bond between the particle core 314 and the coating material 320; the interdiffusion characteristics between the particle core 314 and metallic coating layer 316, including any interdiffusion between the layers of a multilayer coating layer 316; the interdiffusion characteristics between the various layers of a multilayer coating layer 316; the interdiffusion characteristics between the metallic coating layer 316 of one powder particle and that of an adjacent powder particle 312; the bond strength of the metallurgical bond between the metallic coating layers of adjacent sintered powder particles 312, including the outermost layers of multilayer coating layers; and the electrochemical activity of the coating layer 316.

Metallic coating layer 316 and coating material 320 have a melting temperature ($T_C$). As used herein, $T_C$ includes the lowest temperature at which incipient melting or liquation or other forms of partial melting occur within coating material 320, regardless of whether coating material 320 comprises a pure metal, an alloy with multiple phases each having different melting temperatures or a composite, including a composite comprising a plurality of coating material layers having different melting temperatures.

Metallic coating material 320 may include any suitable metallic coating material 320 that provides a sinterable outer surface 321 that is configured to be sintered to an adjacent powder particle 312 that also has a metallic coating layer 316 and sinterable outer surface 321. In powders 310 that also include second or additional (coated or uncoated) particles, as described herein, the sinterable outer surface 321 of metallic coating layer 316 is also configured to be sintered to a sinterable outer surface 321 of second particles. In an exemplary embodiment, the powder particles 312 are sinterable at a predetermined sintering temperature ($T_S$) that is a function of the core material 318 and coating material 320, such that sintering of powder compact 400 is accomplished entirely in the solid state and where $T_S$ is less than $T_P$ and $T_C$. Sintering in the solid state limits particle core 314/metallic coating layer 316 interactions to solid state diffusion processes and metallurgical transport phenomena and limits growth of and provides control over the resultant interface between them. In contrast, for example, the introduction of liquid phase sintering would provide for rapid interdiffusion of the particle core 314/metallic coating layer 316 materials and make it difficult to limit the growth of and provide control over the resultant interface between them, and thus interfere with the formation of the desirable microstructure of particle compact 400 as described herein.

In an exemplary embodiment, core material 318 will be selected to provide a core chemical composition and the coating material 320 will be selected to provide a coating chemical composition and these chemical compositions will also be selected to differ from one another. In another exemplary embodiment, the core material 318 will be selected to provide a core chemical composition and the coating material 320 will be selected to provide a coating chemical composition and these chemical compositions will also be selected to differ from one another at their interface. Differences in the chemical compositions of coating material 320 and core material 318 may be selected to provide different dissolution rates and selectable and controllable dissolution of powder compacts 400 that incorporate them making them selectably and controllably dissolvable. This includes dissolution rates that differ in response to a changed condition in the borehole, including an indirect or direct change in a borehole fluid. In an exemplary embodiment, a powder compact 400 formed from powder 310 having chemical compositions of core material 318 and coating material 320 that make compact 400 is selectably dissolvable in a borehole fluid in response to a changed borehole condition that includes a change in temperature, change in pressure, change in flow rate, change in pH or change in chemical composition of the borehole fluid, or a combination thereof. The selectable dissolution response to the changed condition may result from actual chemical reactions or processes that promote different rates of dissolution, but also encompass changes in the dissolution response that are associated with physical reactions or processes, such as changes in borehole fluid pressure or flow rate.

Figure 15:
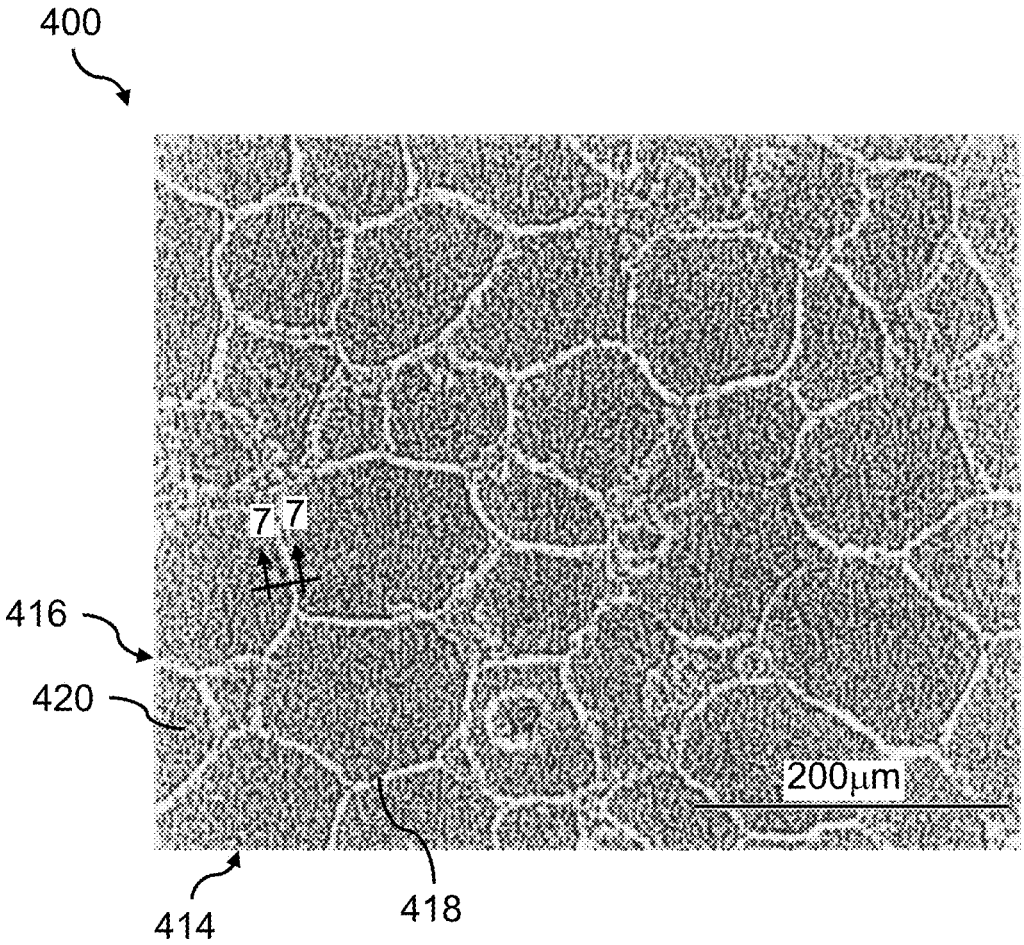
FIG. 15 is a photomicrograph of an exemplary embodiment of a powder compact as disclosed herein.
Figure 16:
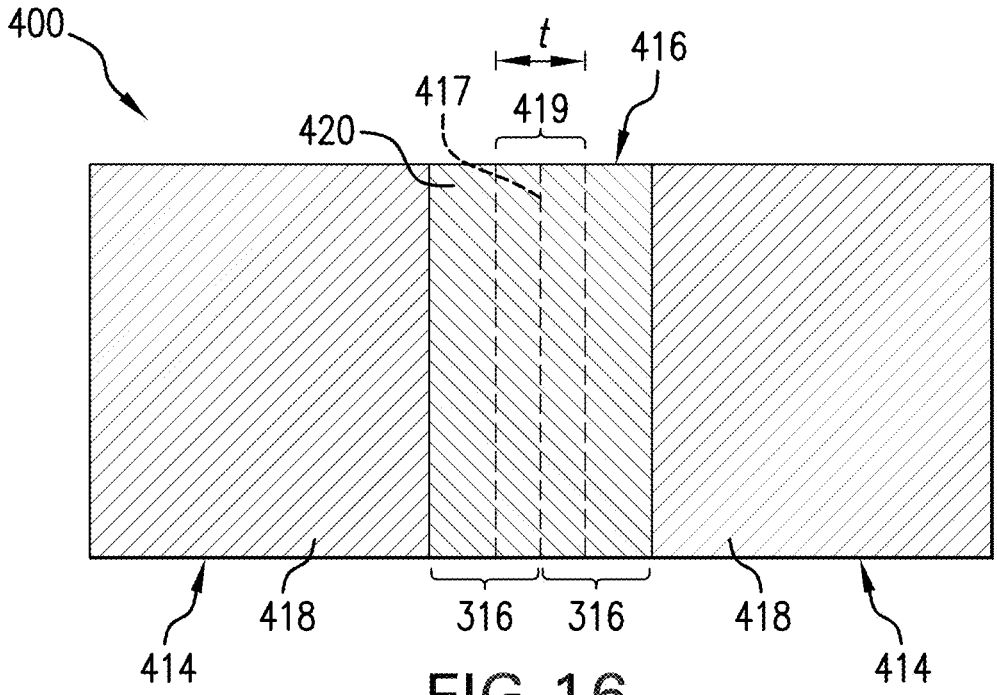
FIG. 16 is a schematic of illustration of an exemplary embodiment of the powder compact of FIG. 15 made using a powder having single-layer powder particles as it would appear taken along section 7-7.
Figure 17:
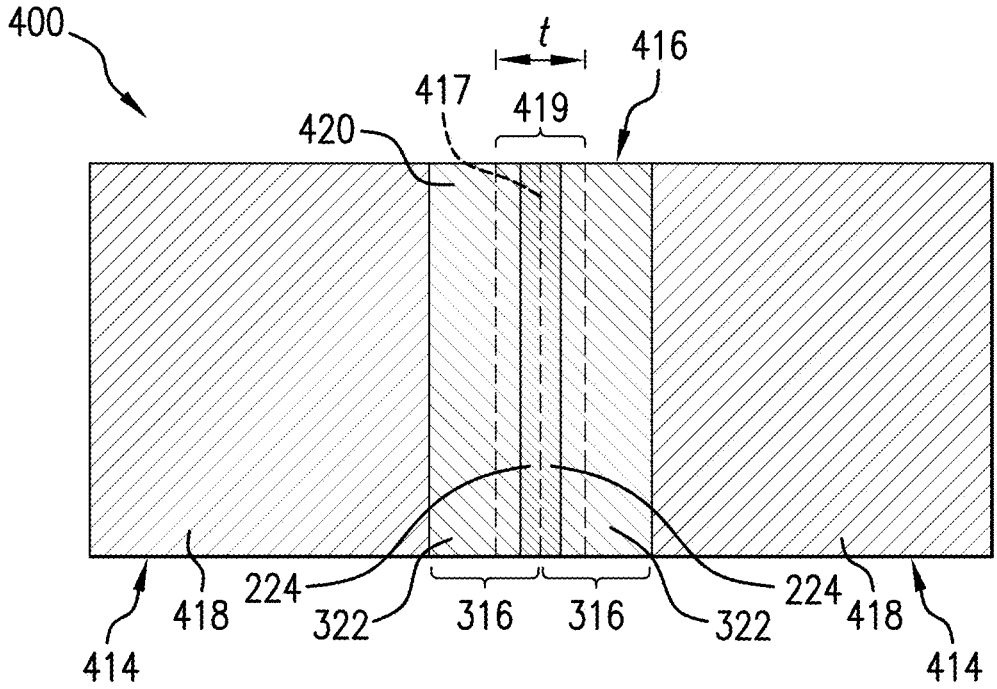
FIG. 17 is a schematic of illustration of another exemplary embodiment of the powder compact of FIG. 15 made using a powder having multilayer powder particles as it would appear taken along section 7-7.

As illustrated in FIGS. 13 and 14, particle core 314 and core material 318 and metallic coating layer 316 and coating material 320 may be selected to provide powder particles 312 and a powder 310 that is configured for compaction and sintering to provide a powder compact 400, shown in FIGS. 15-17, that is lightweight (i.e., having a relatively low density), high-strength and is selectably and controllably removable from a borehole in response to a change in a borehole property, including being selectably and controllably dissolvable in an appropriate borehole fluid, including various borehole fluids as disclosed herein. Powder compact 400 includes a substantially-continuous, cellular nanomatrix 416 of a nanomatrix material 420 having a plurality of dispersed particles 414 dispersed throughout the cellular nanomatrix 416. The substantially-continuous cellular nanomatrix 416 and nanomatrix material 420 formed of sintered metallic coating layers 316 is formed by the compaction and sintering of the plurality of metallic coating layers 316 of the plurality of powder particles 312. The chemical composition of nanomatrix material 420 may be different than that of coating material 320 due to diffusion effects associated with the sintering as described herein. Powder metal compact 400 also includes a plurality of dispersed particles 414 that comprise particle core material 418. Dispersed particle cores 414 and core material 418 correspond to and are formed from the plurality of particle cores 314 and core material 318 of the plurality of powder particles 312 as the metallic coating layers 316 are sintered together to form nanomatrix 416. The chemical composition of core material 418 may be different than that of core material 318 due to diffusion effects associated with sintering as described herein.

As used herein, the use of the term substantially-continuous cellular nanomatrix 416 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 420 within powder compact 400. As used herein, "substantially-continuous" describes the extension of the nanomatrix material throughout powder compact 400 such that it extends between and envelopes substantially all of the dispersed particles 414. Substantially-continuous is used to indicate that complete continuity and regular order of the nanomatrix around each dispersed particle 414 is not required. For example, defects in the coating layer 316 over particle core 314 on some powder particles 312 may cause bridging of the particle cores 214 during sintering of the powder compact 400, thereby causing localized discontinuities to result within the cellular nanomatrix 416, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 420 that encompass and also interconnect the dispersed particles 414. As used herein, "nanomatrix" is used to describe the size or scale of the matrix, particularly the thickness of the matrix between adjacent dispersed particles 414. The metallic coating layers that are sintered together to form the nanomatrix are themselves nanoscale thickness coating layers. Since the nanomatrix at most locations, other than the intersection of more than two dispersed particles 414, generally comprises the interdiffusion and bonding of two coating layers 316 from adjacent powder particles 312 having nanoscale thicknesses, the matrix formed also has a nanoscale thickness (e.g., approximately two times the coating layer thickness as described herein) and is thus described as a nanomatrix. Further, the use of the term dispersed particles 414 does not connote the minor constituent of powder compact 400, but rather refers to the majority constituent or constituents, whether by weight or by volume. The use of the term dispersed particle is intended to convey the discontinuous and discrete distribution of particle core material 418 within powder compact 400.

Powder compact 400 may have any desired shape or size, including that of a cylindrical billet or bar that may be machined or otherwise used to form useful articles of manufacture, including the dissolvable inserts 252. The pressing used to form precursor powder compact and sintering and pressing processes used to form powder compact 400 and deform the powder particles 312, including particle cores 314 and coating layers 316, to provide the full density and desired macroscopic shape and size of powder compact 400 as well as its microstructure. The microstructure of powder compact 400 includes an equiaxed configuration of dispersed particles 414 that are dispersed throughout and embedded within the substantially-continuous, cellular nanomatrix 416 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 416 of sintered metallic coating layers 316 may be produced using constituents where thermodynamic phase equilibrium conditions would not produce an equiaxed structure. The equiaxed morphology of the dispersed particles 414 and cellular network 416 of particle layers results from sintering and deformation of the powder particles 312 as they are compacted and interdiffuse and deform to fill the interparticle spaces 315 (FIG. 13). The sintering temperatures and pressures may be selected to ensure that the density of powder compact 400 achieves substantially full theoretical density.

In an exemplary embodiment as illustrated in FIGS. 16 and 17, dispersed particles 414 are formed from particle cores 314 dispersed in the cellular nanomatrix 416 of sintered metallic coating layers 316, and the nanomatrix 416 includes a solid-state metallurgical bond 417 or bond layer 419, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 316 of adjacent powder particles 312 that are compressed into touching contact during the compaction and sintering processes used to form powder compact 400, as described herein. As such, sintered coating layers 316 of cellular nanomatrix 416 include a solid-state bond layer 419 that has a thickness (t) defined by the extent of the interdiffusion of the coating materials 320 of the coating layers 316, which will in turn be defined by the nature of the coating layers 316, including whether they are single or multilayer coating layers, whether they have been selected to promote or limit such interdiffusion, and other factors, as described herein, as well as the sintering and compaction conditions, including the sintering time, temperature and pressure used to form powder compact 400.

As nanomatrix 416 is formed, including bond 417 and bond layer 419, the chemical composition or phase distribution, or both, of metallic coating layers 316 may change. Nanomatrix 416 also has a melting temperature ($T_M$). As used herein, $T_M$ includes the lowest temperature at which incipient melting or liquation or other forms of partial melting will occur within nanomatrix 416, regardless of whether nanomatrix material 420 comprises a pure metal, an alloy with multiple phases each having different melting temperatures or a composite, including a composite comprising a plurality of layers of various coating materials having different melting temperatures, or a combination thereof, or otherwise. As dispersed particles 414 and particle core materials 418 are formed in conjunction with nanomatrix 416, diffusion of constituents of metallic coating layers 316 into the particle cores 314 is also possible, which may result in changes in the chemical composition or phase distribution, or both, of particle cores 314. As a result, dispersed particles 414 and particle core materials 418 may have a melting temperature ($T_{DP}$) that is different than $T_P$. As used herein, $T_{DP}$ includes the lowest temperature at which incipient melting or liquation or other forms of partial melting will occur within dispersed particles 414, regardless of whether particle core material 418 comprise a pure metal, an alloy with multiple phases each having different melting temperatures or a composite, or otherwise. Powder compact 400 is formed at a sintering temperature ($T_S$), where $T_S$ is less than $T_C$, $T_P$, $T_M$ and $T_{DP}$.

Dispersed particles 414 may comprise any of the materials described herein for particle cores 314, even though the chemical composition of dispersed particles 414 may be different due to diffusion effects as described herein. In an exemplary embodiment, dispersed particles 414 are formed from particle cores 314 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 314. Of these materials, those having dispersed particles 414 comprising Mg and the nanomatrix 416 formed from the metallic coating materials 316 described herein are particularly useful. Dispersed particles 414 and particle core material 418 of Mg, Al, Zn or Mn, or a combination thereof, may also include a rare earth element, or a combination of rare earth elements as disclosed herein in conjunction with particle cores 314.

In another exemplary embodiment, dispersed particles 414 are formed from particle cores 314 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 414 of powder compact 400 may have any suitable particle size, including the average particle sizes described herein for particle cores 414.

Dispersed particles 314 may have any suitable shape depending on the shape selected for particle cores 314 and powder particles 312, as well as the method used to sinter and compact powder 310. In an exemplary embodiment, powder particles 312 may be spheroidal or substantially spheroidal and dispersed particles 414 may include an equiaxed particle configuration as described herein.

The nature of the dispersion of dispersed particles 414 may be affected by the selection of the powder 310 or powders 310 used to make particle compact 400. In one exemplary embodiment, a powder 310 having a unimodal distribution of powder particle 312 sizes may be selected to form powder compact 400 and will produce a substantially homogeneous unimodal dispersion of particle sizes of dispersed particles 414 within cellular nanomatrix 416, as illustrated generally in FIG. 15. In another exemplary embodiment, a plurality of powders 310 having a plurality of powder particles with particle cores 314 that have the same core materials 318 and different core sizes and the same coating material 320 may be selected and uniformly mixed as described herein to provide a powder 310 having a homogenous, multimodal distribution of powder particle 312 sizes, and may be used to form powder compact 400 having a homogeneous, multimodal dispersion of particle sizes of dispersed particles 414 within cellular nanomatrix 416. Similarly, in yet another exemplary embodiment, a plurality of powders 310 having a plurality of particle cores 314 that may have the same core materials 318 and different core sizes and the same coating material 320 may be selected and distributed in a non-uniform manner to provide a non-homogenous, multimodal distribution of powder particle sizes, and may be used to form powder compact 400 having a non-homogeneous, multimodal dispersion of particle sizes of dispersed particles 414 within cellular nanomatrix 416. The selection of the distribution of particle core size may be used to determine, for example, the particle size and interparticle spacing of the dispersed particles 414 within the cellular nanomatrix 416 of powder compacts 400 made from powder 310.

Nanomatrix 416 is a substantially-continuous, cellular network of metallic coating layers 316 that are sintered to one another. The thickness of nanomatrix 416 will depend on the nature of the powder 310 or powders 310 used to form powder compact 400, as well as the incorporation of any second powder, particularly the thicknesses of the coating layers associated with these particles. In an exemplary embodiment, the thickness of nanomatrix 416 is substantially uniform throughout the microstructure of powder compact 400 and comprises about two times the thickness of the coating layers 316 of powder particles 312. In another exemplary embodiment, the cellular network 416 has a substantially uniform average thickness between dispersed particles 414 of about 50 nm to about 5000 nm.

Nanomatrix 416 is formed by sintering metallic coating layers 316 of adjacent particles to one another by interdiffusion and creation of bond layer 419 as described herein. Metallic coating layers 316 may be single layer or multilayer structures, and they may be selected to promote or inhibit diffusion, or both, within the layer or between the layers of metallic coating layer 316, or between the metallic coating layer 316 and particle core 314, or between the metallic coating layer 316 and the metallic coating layer 316 of an adjacent powder particle, the extent of interdiffusion of metallic coating layers 316 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 416 and nanomatrix material 420 may be simply understood to be a combination of the constituents of coating layers 316 that may also include one or more constituents of dispersed particles 414, depending on the extent of interdiffusion, if any, that occurs between the dispersed particles 414 and the nanomatrix 416. Similarly, the chemical composition of dispersed particles 414 and particle core material 418 may be simply understood to be a combination of the constituents of particle core 314 that may also include one or more constituents of nanomatrix 416 and nanomatrix material 420, depending on the extent of interdiffusion, if any, that occurs between the dispersed particles 414 and the nanomatrix 416.

In an exemplary embodiment, the nanomatrix material 420 has a chemical composition and the particle core material 418 has a chemical composition that is different from that of nanomatrix material 420, and the differences in the chemical compositions may be configured to provide a selectable and controllable dissolution rate, including a selectable transition from a very low dissolution rate to a very rapid dissolution rate, in response to a controlled change in a property or condition of the borehole proximate the compact 400, including a property change in a borehole fluid that is in contact with the powder compact 400, as described herein. Nanomatrix 416 may be formed from powder particles 312 having single layer and multilayer coating layers 316. This design flexibility provides a large number of material combinations, particularly in the case of multilayer coating layers 316, that can be utilized to tailor the cellular nanomatrix 416 and composition of nanomatrix material 420 by controlling the interaction of the coating layer constituents, both within a given layer, as well as between a coating layer 316 and the particle core 314 with which it is associated or a coating layer 316 of an adjacent powder particle 312. Several exemplary embodiments that demonstrate this flexibility are provided below.

As illustrated in FIG. 16, in an exemplary embodiment, powder compact 400 is formed from powder particles 312 where the coating layer 316 comprises a single layer, and the resulting nanomatrix 416 between adjacent ones of the plurality of dispersed particles 414 comprises the single metallic coating layer 316 of one powder particle 312, a bond layer 419 and the single coating layer 316 of another one of the adjacent powder particles 312. The thickness (t) of bond layer 419 is determined by the extent of the interdiffusion between the single metallic coating layers 316, and may encompass the entire thickness of nanomatrix 416 or only a portion thereof. In one exemplary embodiment of powder compact 400 formed using a single layer powder 310, powder compact 400 may include dispersed particles 414 comprising Mg, Al, Zn or Mn, or a combination thereof, as described herein, and nanomatrix 316 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 420 of cellular nanomatrix 416, including bond layer 419, has a chemical composition and the core material 418 of dispersed particles 414 has a chemical composition that is different than the chemical composition of nanomatrix material 416. The difference in the chemical composition of the nanomatrix material 420 and the core material 418 may be used to provide selectable and controllable dissolution in response to a change in a property of a borehole, including a borehole fluid, as described herein. In a further exemplary embodiment of a powder compact 400 formed from a powder 310 having a single coating layer configuration, dispersed particles 414 include Mg, Al, Zn or Mn, or a combination thereof, and the cellular nanomatrix 416 includes Al or Ni, or a combination thereof.

In another exemplary embodiment, powder compact 400 is formed from powder particles 312 where the coating layer 316 comprises a multilayer coating layer 316 having a plurality of coating layers, and the resulting nanomatrix 416 between adjacent ones of the plurality of dispersed particles 414 comprises the plurality of layers (t) comprising the coating layer 316 of one particle 312, a bond layer 419, and the plurality of layers comprising the coating layer 316 of another one of powder particles 312. In FIG. 16, this is illustrated with a two-layer metallic coating layer 316, but it will be understood that the plurality of layers of multi-layer metallic coating layer 316 may include any desired number of layers. The thickness (t) of the bond layer 419 is again determined by the extent of the interdiffusion between the plurality of layers of the respective coating layers 316, and may encompass the entire thickness of nanomatrix 416 or only a portion thereof. In this embodiment, the plurality of layers comprising each coating layer 316 may be used to control interdiffusion and formation of bond layer 419 and thickness (t).

Sintered and forged powder compacts 400 that include dispersed particles 414 comprising Mg and nanomatrix 416 comprising various nanomatrix materials as described herein have demonstrated an excellent combination of mechanical strength and low density that exemplify the lightweight, high-strength materials disclosed herein. Examples of powder compacts 400 that have pure Mg dispersed particles 414 and various nanomatrices 416 formed from powders 310 having pure Mg particle cores 314 and various single and multilayer metallic coating layers 316 that include Al, Ni, W or $Al_2O_3$, or a combination thereof. These powders compacts 400 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 400 may also be configured to provide substantially enhanced properties as compared to powder compacts formed from pure Mg particles that do not include the nanoscale coatings described herein. Powder compacts 400 that include dispersed particles 414 comprising Mg and nanomatrix 416 comprising various nanomatrix materials 420 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 400 can be further improved by optimizing powder 310, particularly the weight percentage of the nanoscale metallic coating layers 316 that are used to form cellular nanomatrix 416. Strength of the nanomatrix powder metal compact 400 can be further improved by optimizing powder 310, particularly the weight percentage of the nanoscale metallic coating layers 316 that are used to form cellular nanomatrix 416. For example, varying the weight percentage (wt. %), i.e., thickness, of an alumina coating within a cellular nanomatrix 416 formed from coated powder particles 312 that include a multilayer ($Al/Al_2O_3/Al$) metallic coating layer 316 on pure Mg particle cores 314 provides an increase of 21% as compared to that of 0 wt % alumina.

Powder compacts 400 comprising dispersed particles 414 that include Mg and nanomatrix 416 that includes various nanomatrix materials as described herein have also demonstrated a room temperature sheer strength of at least about 20 ksi. This is in contrast with powder compacts formed from pure Mg powders, which have room temperature sheer strengths of about 8 ksi.

Powder compacts 400 of the types disclosed herein are able to achieve an actual density that is substantially equal to the predetermined theoretical density of a compact material based on the composition of powder 310, including relative amounts of constituents of particle cores 314 and metallic coating layer 316, and are also described herein as being fully-dense powder compacts. Powder compacts 400 comprising dispersed particles that include Mg and nanomatrix 416 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 18:
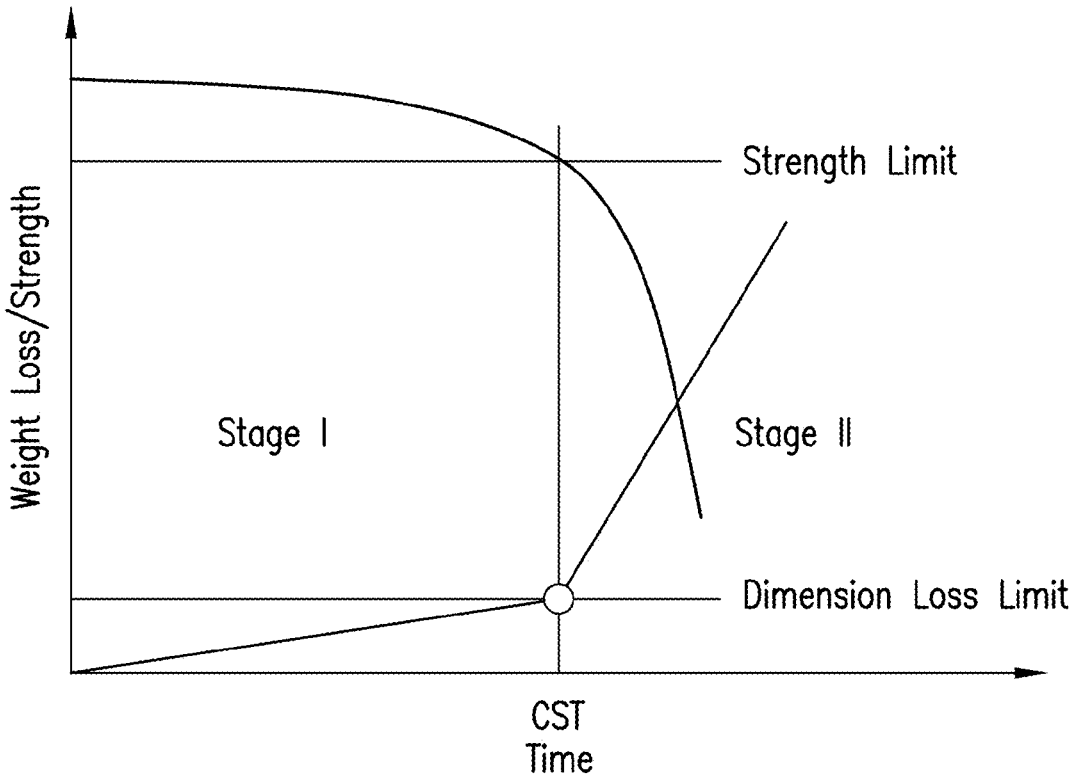
FIG. 18 is a schematic illustration of a change in a property of a powder compact as disclosed herein as a function of time and a change in condition of the powder compact environment.

Powder compacts 400 as disclosed herein may be configured to be selectively and controllably dissolvable in a borehole fluid in response to a changed condition in a borehole. Examples of the changed condition that may be exploited to provide selectable and controllable dissolvability include a change in temperature, change in pressure, change in flow rate, change in pH or change in chemical composition of the borehole fluid, or a combination thereof. An example of a changed condition comprising a change in temperature includes a change in borehole fluid temperature. For example, powder compacts 400 comprising dispersed particles 414 that include Mg and cellular nanomatrix 416 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 216. An example of a changed condition comprising a change in chemical composition includes a change in a chloride ion concentration or pH value, or both, of the borehole fluid. For example, powder compacts 400 comprising dispersed particles 414 that include Mg and nanomatrix 416 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the borehole, namely the change in the borehole fluid chemical composition from KCl to HCl, may be used to achieve a characteristic response as illustrated graphically in FIG. 18, which illustrates that at a selected predetermined critical service time (CST) a changed condition may be imposed upon powder compact 400 as it is applied in a given application, such as a borehole environment, that causes a controllable change in a property of powder compact 400 in response to a changed condition in the environment in which it is applied. For example, at a predetermined CST changing a borehole fluid that is in contact with powder contact 400 from a first fluid (e.g. KCl) that provides a first corrosion rate and an associated weight loss or strength as a function of time to a second borehole fluid (e.g., HCl) that provides a second corrosion rate and associated weight loss and strength as a function of time, wherein the corrosion rate associated with the first fluid is much less than the corrosion rate associated with the second fluid. This characteristic response to a change in borehole fluid conditions may be used, for example, to associate the critical service time with a dimension loss limit or a minimum strength needed for a particular application, such that when a borehole tool or component formed from powder compact 400 as disclosed herein is no longer needed in service in the borehole (e.g., the CST) the condition in the borehole (e.g., the chloride ion concentration of the borehole fluid) may be changed to cause the rapid dissolution of powder compact 400 and its removal from the borehole. In the example described above, powder compact 400 is selectably dissolvable at a rate that ranges from about 0 to about 7000 $mg/cm^2/hr$. This range of response provides, for example the ability to remove a 3-inch diameter ball formed from this material from a borehole by altering the borehole fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 400 described herein and includes a cellular nanomatrix 416 of nanomatrix material 420, a plurality of dispersed particles 414 including particle core material 418 that is dispersed within the matrix. Nanomatrix 416 is characterized by a solid-state bond layer 419, which extends throughout the nanomatrix. The time in contact with the fluid described above may include the CST as described above. The CST may include a predetermined time that is desired or required to dissolve a predetermined portion of the powder compact 400 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 18.

Without being limited by theory, powder compacts 400 are formed from coated powder particles 312 that include a particle core 314 and associated core material 318 as well as a metallic coating layer 316 and an associated metallic coating material 320 to form a substantially-continuous, three-dimensional, cellular nanomatrix 416 that includes a nanomatrix material 420 formed by sintering and the associated diffusion bonding of the respective coating layers 316 that includes a plurality of dispersed particles 414 of the particle core materials 418. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a borehole environment, where the predetermined fluid may be a commonly used borehole fluid that is either injected into the borehole or extracted from the borehole. As will be further understood from the description herein, controlled dissolution of the nanomatrix exposes the dispersed particles of the core materials. The particle core materials may also be selected to also provide selectable and controllable dissolution in the borehole fluid. Alternately, they may also be selected to provide a particular mechanical property, such as compressive strength or sheer strength, to the powder compact 400, without necessarily providing selectable and controlled dissolution of the core materials themselves, since selectable and controlled dissolution of the nanomatrix material surrounding these particles will necessarily release them so that they are carried away by the borehole fluid. The microstructural morphology of the substantially-continuous, cellular nanomatrix 416, which may be selected to provide a strengthening phase material, with dispersed particles 414, which may be selected to provide equiaxed dispersed particles 414, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 400 made using uncoated pure Mg powder and subjected to a shear stress sufficient to induce failure demonstrated intergranular fracture. In contrast, a powder compact 400 made using powder particles 312 having pure Mg powder particle cores 314 to form dispersed particles 414 and metallic coating layers 316 that includes Al to form nanomatrix 416 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including borehole tools and components.

FIG. 1 shows the tool 100 in a run-in position with the valve cover 250 in a position such that the dissolvable insert 252 is aligned with the valve opening 124 of the uphole body portion 120 to prevent any fluids from flowing into or out of the bore 108 through the valve opening 124. The valve sleeve 254 of the valve cover 250 is attached to the uphole body portion 120 by shear pin 126 adjacent the valve opening 124. In the run-in position, a ledge 128 on the uphole body portion 120 between the shear pin 126 and the valve opening 124 abuts with a shoulder 274 on the valve sleeve 254. Also in the run-in position, the ramped surface 260 of the valve sleeve 254 compresses the fingers 154 of the collet 152 of the ball seat 150 inwardly to provide the ball seat 150 in a ball catching position, ready for receipt of a ball 50. The indexing pin 208 is positioned as shown in FIG. 3 within a second section 212 of the indexing path 206.

Figure 4:
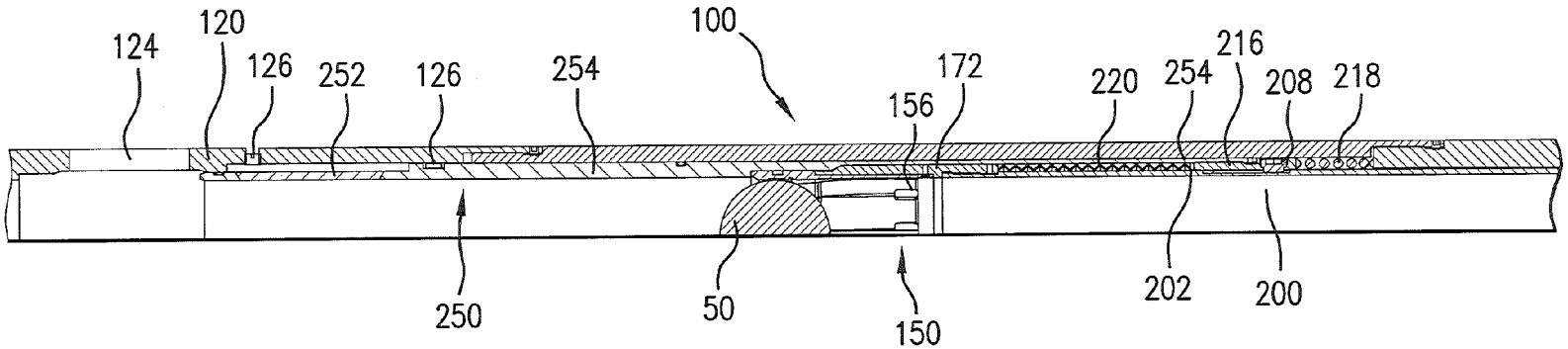
FIG. 4 depicts a cross-sectional view of the selective hydraulic fracturing tool of FIG. 1 with a ball dropped and pressure built therein.
Figure 5:
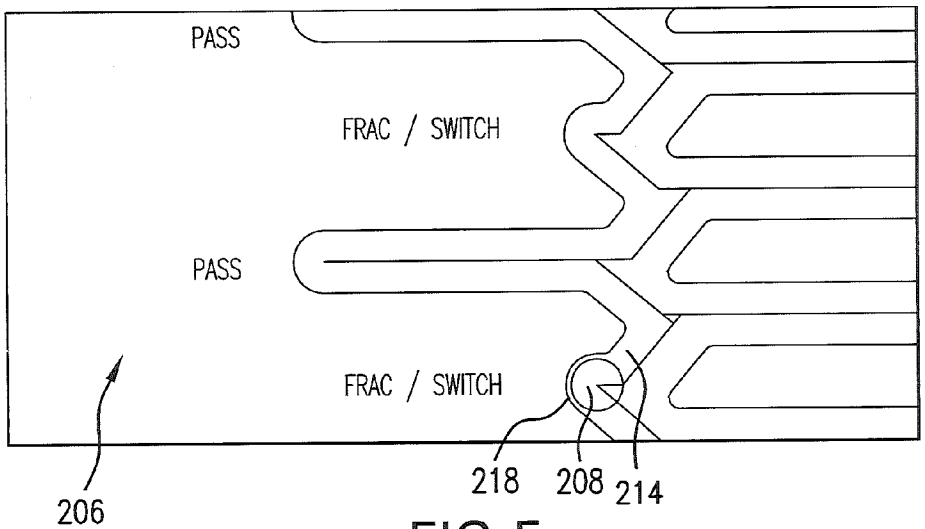
FIG. 5 depicts a schematic view of the portion of the indexing path and indexing pin for the position of the selective hydraulic fracturing tool of FIG. 4.

FIG. 4 shows the tool 100 upon receipt of a ball 50 within the ball seat 150. With the ball 50 completely or at least substantially blocking fluid through the bore 108, pressure can be built uphole of the ball 50 which forces the ball 50 and the accompanying ball seat 150 in a downhole direction. Due to the attachment of the base 156 of the ball seat 150 to the inner tubular 172 which abuts with the indexing apparatus 200, the indexing apparatus 200 also moves in a downhole direction which positions the indexing pin 208 as shown in FIG. 5 within a third section 214 of the indexing path 206 which is a frac/switch position. Because the valve sleeve 254 is fixedly attached to the uphole body portion 120 via the shear pin 126 the ball seat 150 and indexing apparatus 200 cannot move further in the downhole direction until the shear pin 126 is sheared. If pressure is bled off prior to reaching the shear value, the ball seat 150 will return to the run in position and the indexing pin 208 will be positioned in the second position 212 of the indexing path 206. If the pressure is increased past the shear value, the shear pin 126 will shear and the valve cover 250, ball seat 150, and indexing apparatus 200 will move in the downhole direction and compress the compression spring 218 and thus expose the valve opening 124 in the uphole body portion 120. The zone may then be fracked, or other downhole operation may be performed through the valve opening 124. At this stage, the ball seat 150 is locked into position due to the indexing apparatus 200 which, as shown in FIG. 5, is retaining the indexing pin 208 at an uphole end 228 of the third section 214 and will not move from there until pressure is released. The collet 152 of the ball seat 150 is still in the restricted diameter condition to retain the ball 50 therein. As long as the collet 152 is uphole of the ramped surface 260, the collet 152 will remain in the restricted diameter condition.

FIG. 6 shows the tool 100 in a position, such as after a tracking operation on the particular zone is complete, where the pump pressure is bled from the bore 108 of the tool 100 so that the pressure is relieved from the ball seat 150. As the ball 50 and ball seat 150 are allowed to move back towards an uphole position, the valve sleeve 254 returns to the position as shown in FIG. 1 where the insert 252 again blocks the valve opening 124. The valve sleeve 254 is brought back to this position via the spring force of the compression spring 218 which pushes on the movable tubular portion 216 to which the valve sleeve 254 is connected. The shoulder 274 of the valve sleeve 254 abuts with the ledge 128 of the uphole body portion 120 so that the insert 252 aligns appropriately with the valve opening 124. The indexing pin 208 indexes to the second section 212 between the positions shown in FIGS. 4 and 6. When pressure is reapplied with the ball 50 on ball seat 150 the indexing sleeve 202 indexes such that the indexing pin 208 is aligned with the first section 210 corresponding to a "pass" section. With the indexing pin 208 all the way in the extended longitudinal portion of the first section 210, the spring member 220 becomes compressed and the inner tubular 172 is pulled downhole such that the connected collet 152 is pulled downhole. Thus, the funnel shaped portion 162 of the ball seat 150 does not abut with the ledge 258 on the valve sleeve 254, and the ramped surface 170 of the inner tubular 172 does not abut with the ramped surface 260 of the valve sleeve 254 such that the free end 160 of the fingers 154 are no longer compressed together, and thus they assume a condition such that an inner diameter of the collect 152 is large enough to allow the ball 50 to pass there through to a lower, or more downhole, zone.

Figure 8:
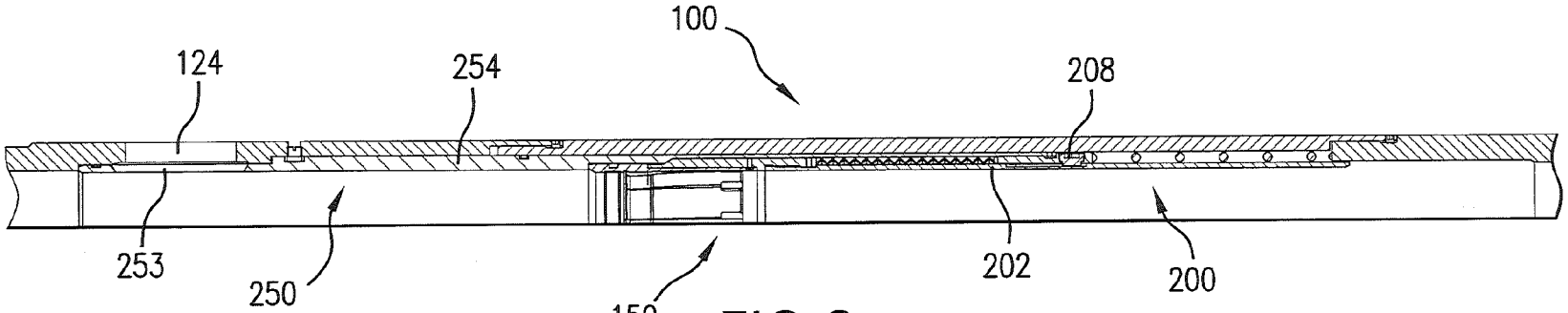
FIG. 8 depicts a cross-sectional view of the selective hydraulic fracturing tool of FIG. 1 with the ball seat retracted.
Figure 9:
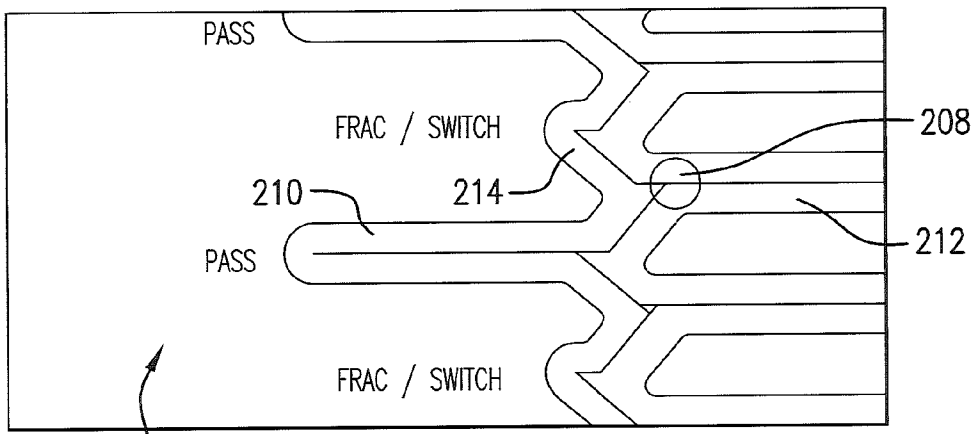
FIG. 9 depicts a schematic view of the portion of the indexing path and indexing pin for the position of the selective hydraulic fracturing tool of FIG. 8.

With respect to FIGS. 8 and 9, after the ball 50 passes, the spring member 220 moves the indexing sleeve 202 back to the second section 212 of the path 206, and the ball seat 150 returns to a reduced diameter condition as shown in FIG. 1 during the run-in position. Different from FIG. 1, however, the dissolvable insert 252 of FIG. 1 is shown in FIG. 8 with the material dissolved at the selected time deemed appropriate by the operator, generally after all zones have been fracked. Once the dissolvable insert 252 is dissolved, aperture 253 in the valve cover 250 is provided and may be selectively aligned with the valve opening 124 in the tubular body 106.

As shown in FIG. 10, the fracture order of operation currently enabled by conventional equipment, as well as enabled by the selective hydraulic fracturing tool, is the "bottom-up" approach. A schematic view of a borehole 10 includes an uphole end 12 closest to a surface location, and a downhole end 14, furthest from the surface location, where the surface location is the point of entry for a bottomhole tool. The borehole 10 is shown with seven zones targeted for fracturing operations, including zones 16, 18, 20, 22, 24, 26, and 28, although a different number of zones may be targeted. In the "bottom-up" approach, the first fracturing operation 1 is conducted at zone 28, the second fracturing operation 2 is conducted at zone 26, the third fracturing operation 3 is conducted at zone 24, the fourth fracturing operation 4 is conducted at zone 22, the fifth fracturing operation 5 is conducted at zone 20, the sixth fracturing operation 6 is conducted at zone 18, and the seventh fracturing operation 7 is conducted at zone 16. Thus, in the "bottom-up" order, the lowest/farthest zone 28 is fractured first, and then fracturing operations are completed up the borehole by fracking each successive zone. In the conventional fracturing tool, the initial fracture would be enabled by dropping a small diameter ball in the tool, and then consecutively larger sized balls would be dropped while working up the borehole. After all the zones are fracked, the balls would flow back to the surface with production.

FIGS. 11 and 12 respectively show two alternative fracture order of operations that are enabled by the selective hydraulic fracturing tool described herein, but not by conventional downhole tools. FIG. 11 shows a "top-down" approach which is a reversal of the "bottom-up" approach shown in FIG. 10. In other words, the first fracturing operation 1 is conducted at zone 16, the second fracturing operation 2 is conducted at zone 18, the third fracturing operation 3 is conducted at zone 20, the fourth fracturing operation 4 is conducted at zone 22, the fifth fracturing operation 5 is conducted at zone 24, the sixth fracturing operation 6 is conducted at zone 26, and the seventh fracturing operation 7 is conducted at zone 28. In this "top-down" order, the highest zone 16 is fracked first, and then fractures are completed working down the borehole by fracking each successive zone. This order was not possible with a conventional fracturing tool because the ball on seat would prevent an operator from producing lower zones, and even if the ball on seat was capable of being removed, the zone that was just fracked would be left open and therefore when a frac is attempted at a lower zone, all of the pumping would be lost to the upper zone. However, in the selective fracturing tool, after fracking an upper zone, the ball must be passed through the expandable ball seat to frac any lower zones, and a single ball could be used to frac all zones.

FIG. 12 shows a "center encroaching" fracture order of operation, where the first fracturing operation 1 is conducted at zone 28, the second fracturing operation 2 is conducted at zone 16, the third fracturing operation 3 is conducted at zone 26, the fourth fracturing operation 4 is conducted at zone 18, the fifth fracturing operation 5 is conducted at zone 24, the sixth fracturing operation 6 is conducted at zone 20, and the seventh fracturing operation 7 is conducted at zone 22. Thus, the "center encroaching" frac operation is where the zones are fractured in an alternating fashion from the lowest to highest zone until the center zone is reached. After fracking an upper zone, the ball must be passed through the expandable ball seat to frac any lower zones. After fracing an upper zone, the ball would be used to frac the corresponding lower zone. In the illustrated embodiment, the zone 16 ball would then pass to zone 26 and frac that zone.

While two additional fracture order of operations have been described, it should be understood that the selective hydraulic fracturing tool may be utilized to fracture zones of the borehole in any order deemed appropriate by the operator or borehole conditions.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A selective downhole tool comprising:

a tubular having a longitudinal bore enabling passage of fluids there through and having a valve opening in a wall of the tubular;

an expandable ball seat selectively movable between a first size sized to trap a ball to block flow through the tubular and a larger second size sized to release the ball through the tubular; and a valve cover longitudinally movable within the tubular, the valve cover including a dissolvable insert;

wherein the insert covers the valve opening in a first condition and is longitudinally movable within the tubular to expose the valve opening in a second condition, and the insert re-covers the valve opening in a third condition.

2. The selective downhole tool of claim 1 wherein the valve cover cooperates with the ball seat and is longitudinally movable with the ball seat in response to a pressure change within the tubular.

3. The selective downhole tool of claim 1 wherein the ball seat has the first size in the first and second conditions, and the second size in the third condition.

4. The selective downhole tool of claim 3, wherein the insert is dissolved in the fourth condition.

5. The selective downhole tool of claim 1, wherein the expandable ball seat includes a collet having a plurality of fingers, the free end of the fingers moving from the first size to the second size, a base connecting a fixed end of the fingers.

6. The selective downhole tool of claim 1, further comprising a shear pin fixedly connecting the valve cover to the tubular in a run-in condition of the tool.

7. The selective downhole tool of claim 1, wherein the dissolvable insert includes a selectively degradable material including a sintered powder compact formed from electrochemically active metals.

8. A selective downhole tool comprising:

a tubular having a longitudinal bore enabling passage of fluids there through and having a valve opening in a wall of the tubular;

an expandable ball seat selectively movable between a first size sized to trap a ball to block flow through the tubular and a larger second size sized to release the ball through the tubular;

a valve cover longitudinally movable within the tubular, the valve cover including a dissolvable insert disposed in an aperture in the valve cover, and the aperture is selectively alignable with the valve opening; and an indexing apparatus engageable with the expandable ball seat, the expandable ball seat lockable in one of the first size and the second size by the indexing apparatus.

9. The selective downhole tool of claim 8, wherein the indexing apparatus includes an indexing sleeve having an indexing path, an indexing pin movable with respect to the indexing sleeve, and at least one spring biasing member acting on the indexing pin.

10. The selective downhole tool of claim 9, wherein the at least one spring biasing member includes a compression spring on one side of the indexing pin and a compression spring on an opposite side of the indexing pin.

11. The selective downhole tool of claim 9, wherein the indexing path includes a uphole extending first section to lock the ball seat in the second size, a downhole extending second section allowing movement of the indexing pin, and an uphole extending third section shorter than the first section to lock the ball seat in the first size.

12. The selective downhole tool of claim 11, wherein the indexing path is a continuous path around a diameter of the indexing sleeve and includes a second section interposed between every first section and third section.

13. A method of operating a downhole tool, the method comprising:

running the downhole tool in a bore hole, the tool including a tubular having a valve opening covered by a valve cover;

moving the valve cover longitudinally to expose the valve opening;

re-covering the valve opening with the valve cover subsequent an operation through the valve opening; and dissolving a portion of the valve cover to re-expose the valve opening.

14. The method of claim 13, further comprising repeating exposing the valve opening, performing an operation through the valve opening, and re-covering the valve opening for a plurality of valve openings and corresponding valve covers, and subsequently dissolving a portion on the valve covers to expose the valve openings.

15. The method of claim 14, wherein the operation is a fracturing operation performed on a plurality of zones of the borehole, and further comprising allowing entry of production fluids through the valve openings after dissolving a portion on the valve covers.

16. The method of claim 14, wherein an order of operations performed through the valve openings is a top-down order where a first operation is performed through an upholemost valve opening and a last operation is performed through a downholemost valve opening.

17. The method of claim 14, wherein an order of operations performed through the valve openings is a center encroaching order where successive operations are performed alternatingly through downhole and uphole valve openings closing in on a center valve opening.

18. The method of claim 13 further comprising:

dropping a ball in the tubular into an expandable ball seat;

catching the ball within the ball seat;

building pressure within the tubular and forcing the ball and ball seat in a downhole direction; and, bleeding pumping pressure;

wherein moving the valve cover longitudinally occurs with the building of pressure within the tubular and re-covering the valve opening with the valve cover occurs with the bleeding of pumping pressure.

19. The method of claim 13, wherein the valve cover is fixedly attached to the tubular via a shear screw while running the downhole tool in the bore hole, and further comprising shearing the screw after the valve opening is aligned with a target zone in the bore hole.

* * * * *